US008077126B2

(12) United States Patent
Lee et al.

(10) Patent No.: US 8,077,126 B2
(45) Date of Patent: Dec. 13, 2011

(54) DISPLAY DEVICE AND DRIVING METHOD THEREOF

(75) Inventors: Baek-Woon Lee, Yongin-si (KR); Oh-Kyong Kwon, Seoul (KR)

(73) Assignees: Samsung Electronics Co., Ltd., Suwon-si (KR); IUCF-HYU, Seoul (KR)

( * ) Notice: Subject to any disclaimer, the term of this patent is extended or adjusted under 35 U.S.C. 154(b) by 503 days.

(21) Appl. No.: 12/413,171

(22) Filed: Mar. 27, 2009

(65) Prior Publication Data

US 2010/0079361 A1 Apr. 1, 2010

(30) Foreign Application Priority Data

Sep. 29, 2008 (KR) ..... 10-2008-0095208

(51) Int. Cl.
*G09G 3/30* (2006.01)

(52) U.S. Cl. ..... 345/77; 345/92

(58) Field of Classification Search ..... 345/77–79, 345/87–102, 204
See application file for complete search history.

(56) References Cited

U.S. PATENT DOCUMENTS

| | | | | |
|---|---|---|---|---|
| 7,126,566 | B2 | 10/2006 | Lo | |
| 7,646,367 | B2 * | 1/2010 | Kimura | 345/82 |
| 2003/0103022 | A1 | 6/2003 | Noguchi | |
| 2003/0193457 | A1 * | 10/2003 | Wang et al. | 345/84 |
| 2006/0164359 | A1 * | 7/2006 | Kimura | 345/92 |
| 2006/0267049 | A1 * | 11/2006 | Tang et al. | 257/225 |
| 2007/0057873 | A1 | 3/2007 | Uchino | |
| 2007/0241999 | A1 | 10/2007 | Lin | |
| 2007/0242031 | A1 * | 10/2007 | Kimura et al. | 345/102 |
| 2010/0110113 | A1 * | 5/2010 | Kimura | 345/690 |
| 2010/0245219 | A1 * | 9/2010 | Shishido | 345/80 |

FOREIGN PATENT DOCUMENTS

| | | |
|---|---|---|
| JP | 2003173154 | 6/2003 |
| JP | 2003208127 | 7/2003 |
| JP | 2004347993 | 12/2004 |
| JP | 2005091443 | 4/2005 |
| JP | 2006098437 | 4/2006 |
| JP | 2007171828 | 7/2007 |
| JP | 2007310311 | 11/2007 |
| JP | 2008051834 | 3/2008 |

(Continued)

*Primary Examiner* — Nitin Patel
(74) *Attorney, Agent, or Firm* — H.C. Park & Associates, PLC

(57) ABSTRACT

In a pixel of a display device, a first transistor of which an second terminal is connected to a first terminal of a light emitting element supplies a driving current that corresponds to a voltage between a control terminal and the second terminal to the light emitting element, and a second terminal of the light emitting element is connected to a driving voltage. At least one second transistor transmits a black voltage that corresponds to a black gray to the control terminal of the first transistor in a first period and a second period, and transmits a gray voltage that corresponds to an input image signal to the control terminal of the first transistor in a third period. A third transistor is connected between the first terminal of the light emitting element and a voltage supply line to transmit a reference voltage, and the third transistor is turned on in the first period and turned off in the second period. A capacitor is connected between the control terminal and the source of the first transistor, stores a control voltage based on a threshold voltage of the first transistor in the second period, and stores a voltage based on the control voltage and the gray voltage in the third period.

28 Claims, 22 Drawing Sheets

FOREIGN PATENT DOCUMENTS

| | | |
|---|---|---|
| KR | 1020030038522 | 5/2003 |
| KR | 100475939 | 3/2005 |
| KR | 1020050115346 | 12/2005 |
| KR | 1020060023534 | 3/2006 |
| KR | 100675939 | 1/2007 |
| KR | 100688799 | 2/2007 |
| KR | 100719924 | 5/2007 |
| KR | 100731741 | 6/2007 |
| KR | 1020070120861 | 12/2007 |

* cited by examiner

DISPLAY DEVICE AND DRIVING METHOD THEREOF

CROSS REFERENCE TO RELATED APPLICATION

This application claims priority from and the benefit of Korean Patent Application No. 10-2008-0095208, filed on Sep. 29, 2008, which is hereby incorporated by reference for all purposes as if fully set forth herein.

BACKGROUND OF THE INVENTION

1. Field of the Invention

The present invention relates to a display device and a driving method thereof.

2. Discussion of the Background

Display devices may include a plurality of pixels arranged in a matrix, whereby images are displayed by controlling the optical intensity of each of the pixels on the basis of predetermined luminance information. Among display devices, an organic light emitting display displays images by electrically exciting light emitting fluorescent materials. An organic light emitting display is self-luminous, may have low power consumption, a wide viewing angle, and good response speed of a pixel, and may easily display high-quality moving pictures.

Each pixel of the organic light emitting display includes an organic light emitting element and a transistor to drive the element. The transistor may be a thin film transistor (TFT). The TFT may be a crystalline silicon TFT, such as a polycrystalline or micro-crystalline silicon TFT, or an amorphous silicon TFT in accordance with the type of active layer.

When the active layer of the TFT is formed, deviation in threshold voltages of the TFTs in a display panel may occur due to non-uniformity in a manufacturing process. When the deviation in the threshold voltages of the TFTs occur, the TFTs may allow currents of different intensities to flow with respect to the same gray voltage. As a result, brightness uniformity of a screen may deteriorate.

SUMMARY OF THE INVENTION

The present invention provides a display device and a driving method thereof that may compensate a threshold voltage of a thin film transistor.

Additional features of the invention will be set forth in the description which follows, and in part will be apparent from the description, or may be learned by practice of the invention.

The present invention discloses a display device that includes a plurality of pixels. Each pixel includes a light emitting element, a first transistor, at least one second transistor, a third transistor, and a capacitor. The light emitting element includes a first terminal and a second terminal, and the second terminal is connected to a first driving voltage. The first transistor includes a control terminal, a first terminal, and a second terminal connected to the first terminal of the light emitting element, and the first transistor supplies a driving current to the light emitting element. The driving current corresponds to a voltage between the control terminal and the second terminal. The at least one second transistor transmits a black voltage that corresponds to a black gray to the gate of the first transistor in a first period and a second period, and transmits a gray voltage that corresponds to an input image signal to the control terminal of the first transistor in a third period. The third transistor is connected between the first terminal of the light emitting element and a voltage supply line that transmits a reference voltage, and the third transistor is turned on in the first period and turned off in the second period. The capacitor is connected between the control terminal and the second terminal of the first transistor. The capacitor stores a control voltage based on a threshold voltage of the first transistor in the second period and then stores a voltage based on the control voltage and the gray voltage in the third period.

The present invention also discloses a display device that includes a signal line, a scan line, a data line, a light emitting element, a first transistor, a second transistor, a third transistor, a fourth transistor, and a capacitor. The signal line transmits a first control signal, and the first control signal includes a first switch-on voltage in a first period and a second period. The scan line includes a scan signal, and the scan signal includes a second switch-on voltage in a third period. The data line transmits a gray voltage that corresponds to an input image signal. The light emitting element includes a first terminal and a second terminal connected to a first driving voltage. The first transistor includes a control terminal, a first terminal, and a second terminal connected to a first terminal of the light emitting element. The second transistor is connected between the data line and the control terminal of the first transistor, and the second transistor is turned on in response to the second switch-on voltage of the scan signal. The third transistor is connected between a black voltage that corresponds to a black gray and the control terminal of the first transistor, and the third transistor is turned on in response to the first switch-on voltage of the first control signal. The fourth transistor is connected between the first terminal of the light emitting element and a reference voltage, and the fourth transistor is turned on in response to a third switch-on voltage of a second control signal. The second control signal has the third switch-on voltage in the first period and a switch-off voltage in the second period. The capacitor is connected between the control terminal and the second terminal of the first transistor.

The present invention also discloses a method of driving a display device that includes a driving transistor having a control terminal, a first terminal, and a second terminal, at least one switching transistor connected to the control terminal of the driving transistor, a light emitting element including a first terminal and a second terminal connected to a first driving voltage, and a capacitor connected between the control terminal and the second terminal of the driving transistor. The method includes applying a black voltage that corresponds to a black gray to the control terminal of the driving transistor through the at least one switching transistor in a first period and a second period, connecting the first terminal of the light emitting element to a reference voltage in the first period, separating the first terminal of the light emitting element from the reference voltage in the second period, and applying a gray voltage that corresponds to an input image signal to the control terminal of the driving transistor through the at least one switching transistor in a third period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
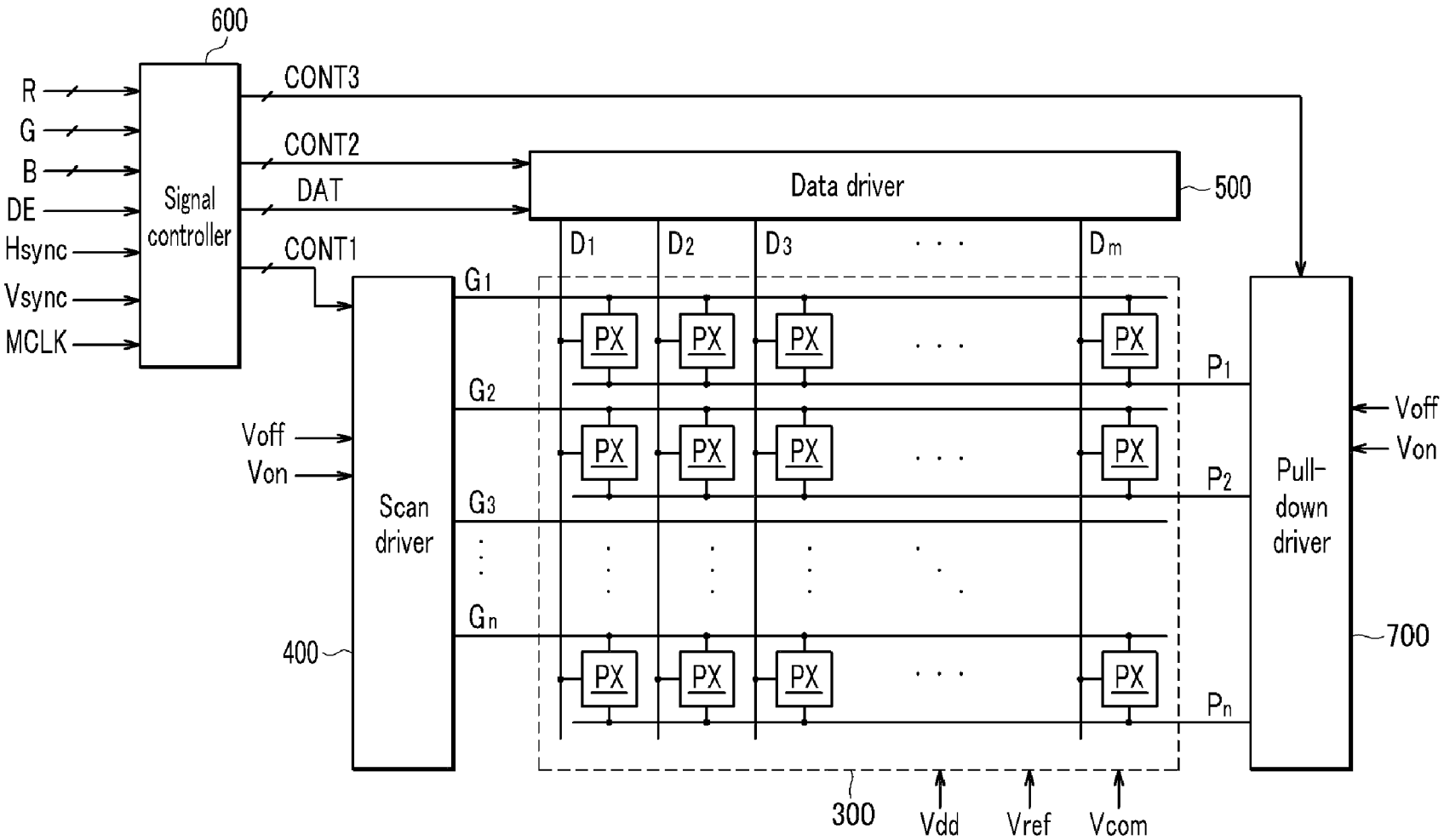
FIG. 1 is a block diagram of an organic light emitting display according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Hereinafter, a display device and a driving method thereof according to an exemplary embodiment will be described in detail with reference to the accompanying drawings.

First, referring to FIG. 1 and FIG. 2, a display device according to an exemplary embodiment of the present invention will be described. In one exemplary embodiment of the present invention, an organic light emitting display using an organic light emitting element as a light emitting element will be described.

An organic light emitting display according to an exemplary embodiment of the present invention will be described in detail below.

Figure 2:
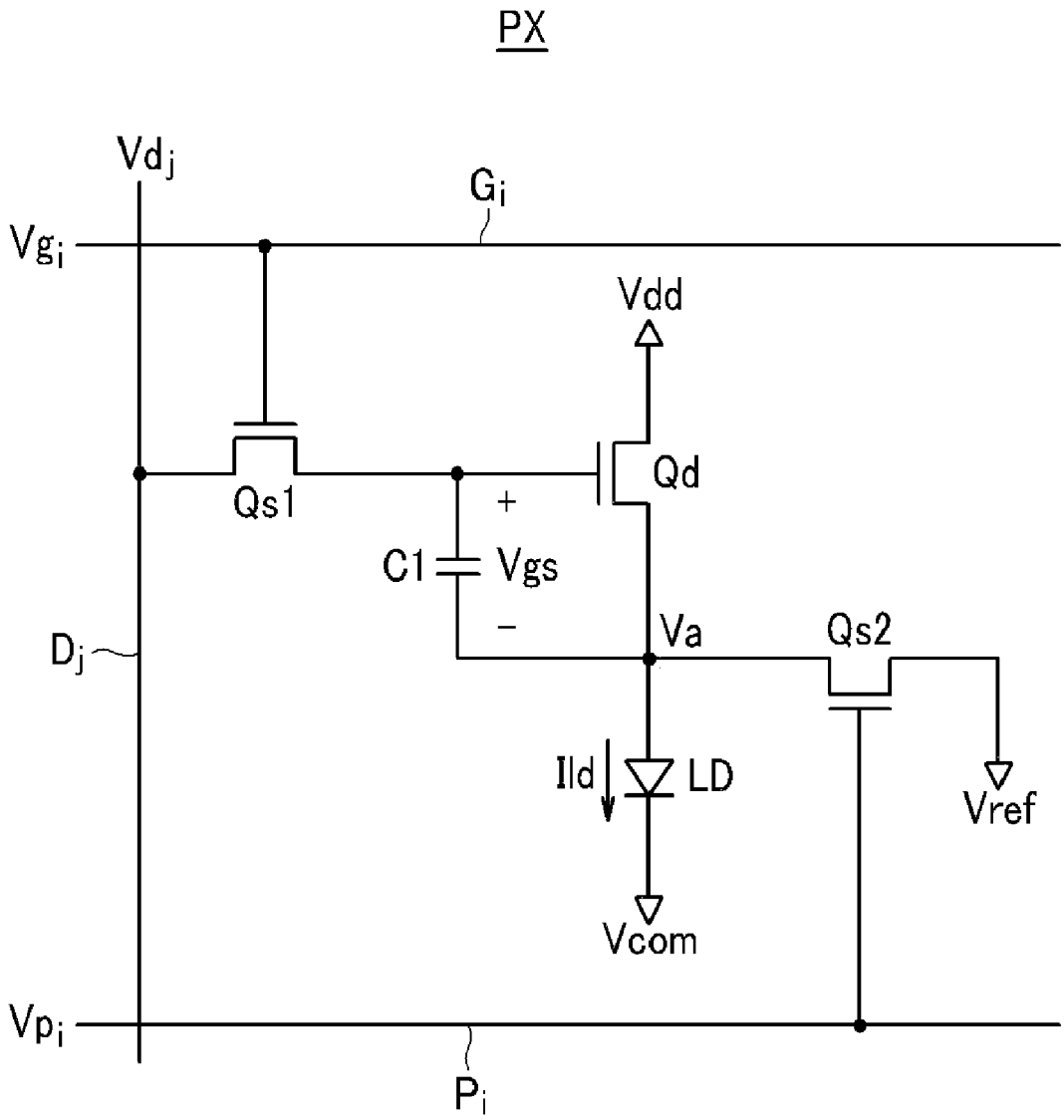
FIG. 2 is an equivalent circuit diagram of one pixel in an organic light emitting display according to an exemplary embodiment of the present invention.

FIG. 1 is a block diagram of an organic light emitting display according to an exemplary embodiment of the present invention, and FIG. 2 is an equivalent circuit diagram of one pixel in an organic light emitting display according to an exemplary embodiment of the present invention.

Referring to FIG. 1, an organic light emitting display according an exemplary embodiment of the present invention includes a display panel 300, a scan driver 400, a data driver 500, a pull-down driver 700, and a signal controller 600.

Referring to FIG. 1, the display panel 300 includes a plurality of signal lines $G_1$-$G_n$, $D_1$-$D_m$, and $P_1$-$P_n$, a plurality of voltage lines (not shown), and a plurality of pixels PX that are connected to the plurality of signal lines and the plurality of voltages lines and arranged substantially in a matrix.

The signal lines $G_1$-$G_n$, $D_1$-$D_m$, and $P_1$-$P_n$, include a plurality of scan lines $G_1$-$G_n$ that transmit scan signals $Vg_1$-$Vg_n$, a plurality of data lines $D_1$-$D_m$, that transmit data signals $Vd_1$-$Vd_n$, and a plurality of pull-down signal lines $P_1$-$P_n$ that transmit pull-down signals $Vp_1$-$Vp_n$, which are signals for controlling the operation of the pixels PX. The scan lines $G_1$-$G_n$ and the pull-down signal lines $P_1$-$P_n$ each extend in a row direction and are substantially parallel to each other. The data lines $D_1$-$D_m$ extend in a column direction and are substantially parallel to each other.

The voltage lines may include a driving voltage line (not shown) that transmits one driving voltage Vdd, another driving voltage line (not shown) that transmits another driving voltage Vcom, and a reference voltage line (not shown) that transmits a reference voltage Vref. The driving voltage line that transmits the driving voltage Vcom may be formed commonly with respect to all the pixels PX of the display panel 300, and the driving voltage Vcom will now be referred to as a common voltage Vcom for convenience of description.

Referring to FIG. 2, each of the pixels PX, for example a pixel PX that is connected to an i-th (i=1, 2, . . . , n) scan line $G_i$ and a j-th (j=1, 2, . . . , m) data line $D_j$, includes an organic light emitting element LD, a driving transistor Qd, a capacitor C1, and switching transistors Qs1 and Qs2.

Each of the driving transistor Qd and the switching transistors Qs1 and Qs2 has a control terminal, and two terminals (i.e., a first terminal and a second terminal), and the two terminals are an input terminal and an output terminal. In FIG. 2, the switching transistors Qs1 and Qs2 and the driving transistor Qd are assumed to be n-channel field effect transistors (FETs) that are made of amorphous silicon or polycrystalline silicon, and in this example, the control terminal, the input terminal, and the output terminal of each transistor correspond to a gate, a drain, and a source, respectively.

The control terminal of the switching transistor Qs1 is connected to the scan line $G_i$, the input terminal of the switching transistor Q1 is connected to the data line $D_j$, and the output terminal of the switching transistor Qs1 is connected to one terminal of the capacitor C1 and the control terminal of the driving transistor Qd. The other terminal of the capacitor C1 is connected to the output terminal of the driving transistor Qd. The switching transistor Qs1 transmits the data signal $Vd_j$ applied to the data line $D_j$ in response to the scan signal $Vg_i$ applied to the scan line $G_i$. The capacitor C1 charges a voltage of the data signal $Vd_j$ and maintains the voltage even after the switching transistor Qs1 is turned off.

The input terminal of the driving transistor Qd is connected to the driving voltage line that transmits the driving voltage Vdd. The driving transistor Qd allows an output current Ild to flow. The intensity of the output current Ild depends on a voltage (hereinafter, referred to as "gate-source voltage Vgs") applied between the control terminal and the output terminal, i.e., a voltage between both terminals of the capacitor C1.

The organic light emitting element LD may be an organic light emitting diode (OLED), and has an anode connected to the output terminal of the driving transistor Qd and a cathode connected to the common voltage Vcom. The common voltage Vcom is lower than the driving voltage Vdd, and for example, the common voltage Vcom is 0V or a negative voltage. The organic light emitting element LD emits light at different intensities to display images. The intensity of emitted light is based on the output current Ild of the driving transistor Qd.

The organic light emitting element LD can emit light having one color among primary colors. For example, the primary colors include three primary colors such as red, green, and blue. A desired color is displayed by a spatial sum or a temporal sum of the three primary colors. In this case, some organic light emitting elements LD may emit white light and thus increase luminance. Alternatively, the organic light emitting elements LD of all pixels PX may emit white light, and some pixels PX may further include a color filter (not shown) that converts the white light emitted from the organic light emitting element LD into any one light of the primary colors.

The control terminal of the switching transistor Qs2 is connected to the pull-down signal line $P_i$, the input terminal of the switching transistor Qs2 is connected to the anode of the organic light emitting element LD, and the output terminal of the switching transistor Qs2 is connected to the reference voltage line. The switching transistor Qs2 pulls down an anode voltage Va of the organic light emitting element LD to the reference voltage Vref in response to the pull-down signal $Vp_i$ applied to the pull-down signal line $P_i$. When the driving transistor Qd is an n-channel field effect transistor, the reference voltage Vref may be lower than a voltage representing a black gray (hereinafter, referred to as "black voltage") Vb.

Referring back to FIG. 1, the scan driver 400 is connected to the scan lines $G_1$-$G_n$ of the display panel 300 and applies a scan signal, which is composed of a combination of a switch-on voltage Von to turn on the switching transistor Qs1 and a switch-off voltage Voff to turn off the switching transistor Qs1, to the scan lines $G_1$-$G_n$.

The data driver 500 is connected to the data lines $D_1$-$D_m$ of the display panel 300, and applies the data signals $Vd_1$-$Vd_m$ having a gray voltage representing an input image signal or a voltage representing the black voltage Vb to the data lines $D_1$-$D_m$.

The pull-down driver 700 is connected to the pull-down signal lines $P_1$-$P_n$ of the display panel 300 and applies the pull-down signals $Vp_1$-$Vp_n$ to the pull-down signal lines $P_1$-$P_n$. The pull-down signals $Vp_1$-$Vp_n$ are composed of the combination of a switch-on voltage Von to turn on the switching transistor Qs2 and a switch-off voltage Voff to turn off the switching transistor Qs2. Alternatively, the scan driver 400 may be connected to the pull-down signal lines $P_1$-$P_n$ and may apply the pull-down signals $Vp_1$-$Vp_n$ to the pull-down signal lines $P_1$-$P_n$. Thus, the pull-down driver 700 may be eliminated.

When the switching transistors Qs1 and Qs2 are n-channel field effect transistors, the switch-on voltage Von and the switch-off voltage Voff are a high voltage and a low voltage, respectively.

The signal controller 600 controls the scan driver 400, the data driver 500, and the pull-down driver 700.

Each of the drivers 400, 500, 600, and 700 may be mounted directly on the display panel 300 in the form of at least one integrated circuit chip, may be mounted on a flexible printed circuit film (not shown) and attached to the display panel 300 in the form of a tape carrier package (TCP), or may be mounted on an additional printed circuit board (not shown). Alternatively, the drivers 400, 500, 600, and 700 may be integrated with the display panel 300 together with the signal lines $G_1$-$G_n$, $D_1$-$D_m$, and $P_1$-$P_n$ and the thin film transistors Qs1, Qs2, and Qd. The drivers 400, 500, 600, and 700 may be integrated on a single chip. In this case, at least one of them or at least one circuit element constituting them may be installed on the single chip.

Hereinafter, the operation of one pixel in the organic light emitting display will be described in detail with reference to FIG. 3, FIG. 4, FIG. 5, FIG. 6, FIG. 7, FIG. 8, FIG. 9, and FIG. 10.

Figure 3:
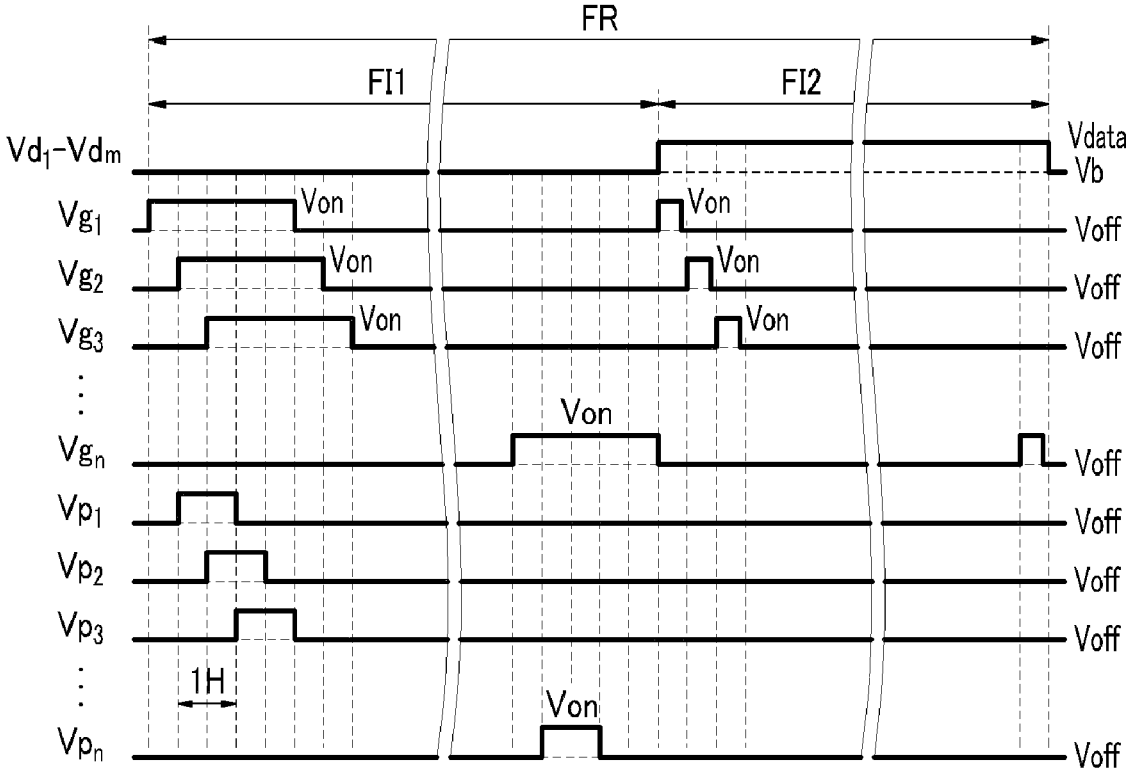
FIG. 3 is a timing diagram of a driving signal of an organic light emitting display according to an exemplary embodiment of the present invention.

FIG. 3 is a timing diagram of a driving signal of an organic light emitting display according to an exemplary embodiment of the present invention.

The signal controller 600 receives input image signals R, G, and B and input control signals controlling the display thereof from an external graphics controller (not shown). The input image signals R, G, and B contain luminance information of each pixel PX and the luminance has grays of a predetermined number, for example, 1024 ($=2^{10}$), 256 ($=2^8$), or 64 ($=2^6$). For example, the input control signals include a vertical synchronization signal Vsync and a horizontal synchronization signal Hsync, a main clock signal MCLK, a data enable signal DE, etc.

The signal controller 600 properly processes the input image signals R, G, and B to fit an operation condition of the display panel 300 on the basis of the input image signals R, G, and B and the input control signals, and generates a scanning control signal CONT1, a data control signal CONT2, and a pull-down control signal CONT3. Thereafter, the signal controller 600 transmits the scanning control signal CONT1 to the scan driver 400, transmits the data control signal CONT2 and a processed signal DAT to the data driver 500, and transmits the pull-down control signal CONT3 to the pull-down driver 700. At this time, the signal controller 600 may partition one frame FR into a plurality of fields, for example, a black field Fl1 and an image field Fl2.

The scanning control signal CONT1 includes a scanning start signal STV directing a scanning start and at least one clock signal for controlling an output cycle of the high voltage Von. The scanning control signal CONT1 may also further include an output signal enable signal OE for limiting a continuous time of the high voltage Von of the scan signals $Vg_1$-$Vg_n$.

The data control signal CONT2 includes a horizontal synchronization signal STH for directing a transmission start of the digital image signal DAT for one row of pixels PX, a load signal LOAD for applying the data signal to the data lines $D_1$-$D_m$, and a data clock signal HCLK.

In accordance with the data control signal CONT2 from the signal controller 600, the data driver 500 receives the digital image signal DAT for one row of pixels PX, applies the data signals $Vd_1$-$Vd_m$ having the black voltage Vb in the black field Fl1 to the data lines $D_1$-$D_m$, selects a gray voltage Vdata corresponding to each digital image signal DAT in the image filed Fl2, converts the digital image signal DAT into the data signal having the gray voltage, and applies the data signal having the gray voltage to the corresponding data lines $D_1$-$D_m$. Meanwhile, the gray voltage Vdata has a value corresponding to the digital image signal DAT of the corresponding pixel PX, but it is assumed that the same gray voltage Vdata is applied to all the pixels in FIG. 3. Further, when the driving transistor Qd is an n-channel field effect transistor, the black voltage Vb may be the lowest voltage among a plurality of gray voltages Vdata corresponding to the gray of a predetermined number.

First, the scan driver 400 sequentially applies the high voltages Von of the scan signals $Vg_1$-$Vg_n$ to the scan lines $G_1$-$G_n$ in accordance with the scanning control signal CONT1 from the signal controller 600 in the black field Fl1. Subsequently, the pull-down driver 700 sequentially applies the high voltages Von of the pull-down signals $Vp_1$-$Vp_n$ to the pull-down signal lines $P_1$-$P_n$ in accordance with the pull-down control signal CONT3 from the signal controller 600. As a result, in a period in which the scan signals $Vg_1$-$Vg_n$ have the high voltage Von, when the voltage of the pull-down signals $Vp_1$-$Vp_n$ are converted from the high voltage Von to the low voltage Voff, the threshold voltage Vth of the driving transistor Qd is stored in the capacitor C1 of the corresponding pixel PX.

When the black field Fl1 ends, the image field Fl2 is started and the operation of the data driver 500 is controlled so that the data signals $Vd_1$-$Vd_m$ applied to the pixels PX have the gray voltage Vdata corresponding to the digital image signal DAT.

While the scan driver 400 sequentially applies the high voltages Von of the scan signals $Vg_1$-$Vg_n$ to the scan lines $G_1$-$G_n$ in accordance with the scanning control signal CONT1 from the signal controller 600 again in the image field Fl12, the data driver 500 sequentially applies the gray voltage to a plurality of pixel rows through the plurality of data lines $D_1$-$D_m$ to display the images.

After one frame FR ends, the next frame FR starts. Here, one frame FR includes the two fields Fl1 and Fl2.

Hereinafter, the operation of the pixel PX connected to one pixel PX, for example an i-th scan line $G_i$ and a j-th data line $D_j$, in the organic light emitting display will be described in detail with reference to FIG. 4, FIG. 5, FIG. 6, FIG. 7, FIG. 8, FIG. 9, and FIG. 10.

Figure 4:
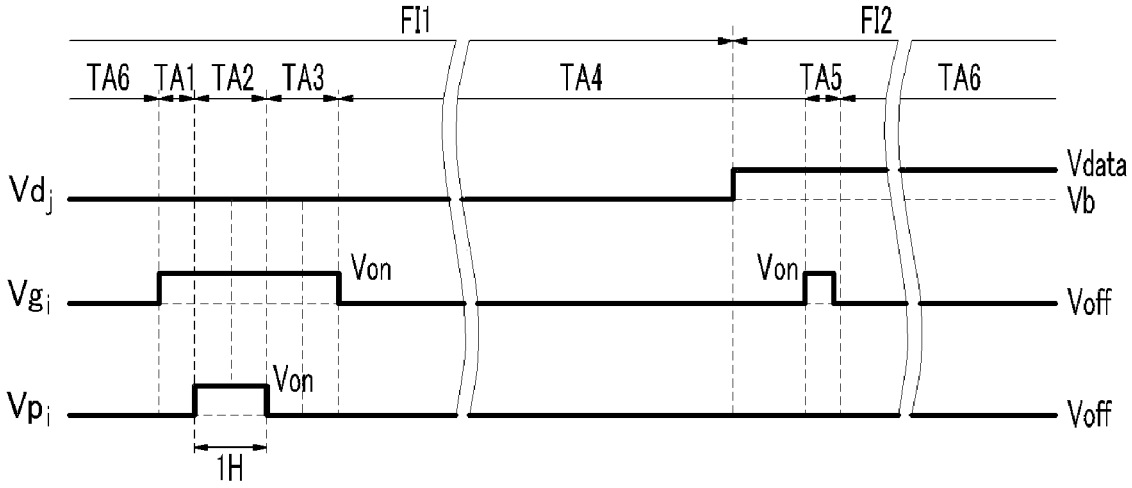
FIG. 4 is one example of a timing diagram of a driving signal of one pixel in an organic light emitting display according to an exemplary embodiment of the present invention.
Figure 5:
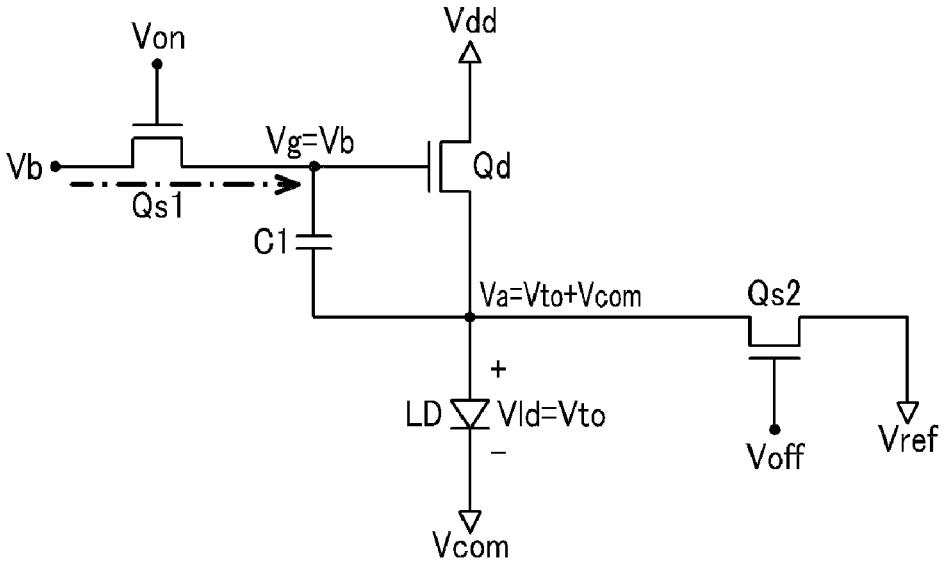
FIG. 5, FIG. 6, FIG. 7, FIG. 8, FIG. 9, and FIG. 10 are equivalent circuit diagrams for one pixel in each period shown in FIG. 4.

FIG. 4 is one example of a timing diagram of a driving signal of one pixel in an organic light emitting display according to an exemplary embodiment of the present invention, and FIG. 5, FIG. 6, FIG. 7, FIG. 8, FIG. 9, and FIG. 10 are equivalent circuit diagrams for one pixel in each period shown in FIG. 4.

Referring to FIG. 4, first, while the pull-down signal $Vp_i$ maintains the low voltage Voff in the black field Fl1, the scan driver 400 allows the scan signal $Vg_i$ to have the high voltage Von, thereby turning on the switching transistor Qs1. At this time, while the switching transistor Qs2 connected to the pull-down signal line $Vp_i$ is turned off, the data driver 500 applies the data signal $Vd_j$ having the black voltage Vb to the data line $D_j$.

The equivalent circuit of the pixel in the state described above is shown in FIG. 5. This period is called a light emitting interception period TA1.

As a result, a control terminal voltage Vg of the driving transistor Qd becomes the black voltage Vb, and thus the driving transistor Qd is turned off. Therefore, the organic light emitting element LD does not emit the light and a voltage Vld (hereinafter, referred to as "voltage Vld of the organic light emitting element LD") between the anode and the cathode of the organic light emitting element LD becomes a turn-on voltage Vto of the organic light emitting element LD. That is, an anode voltage of the organic light emitting element LD, i.e., an output terminal voltage Va of the driving transistor Qd, drops to a voltage Vto+Vcom.

Subsequently, the pull-down driver 700 turns on the switching transistor Qs2 by converting the pull-down signal $Vp_i$ into the high voltage Von to start a pull-down period TA2. The scan signal $Vg_i$ maintains the high voltage Von and the data signal $Vd_j$ maintains the black voltage Vb even in this period TA2. Therefore, the control terminal voltage Vg of the driving transistor Qd maintains the black voltage Vb.

Figure 6:
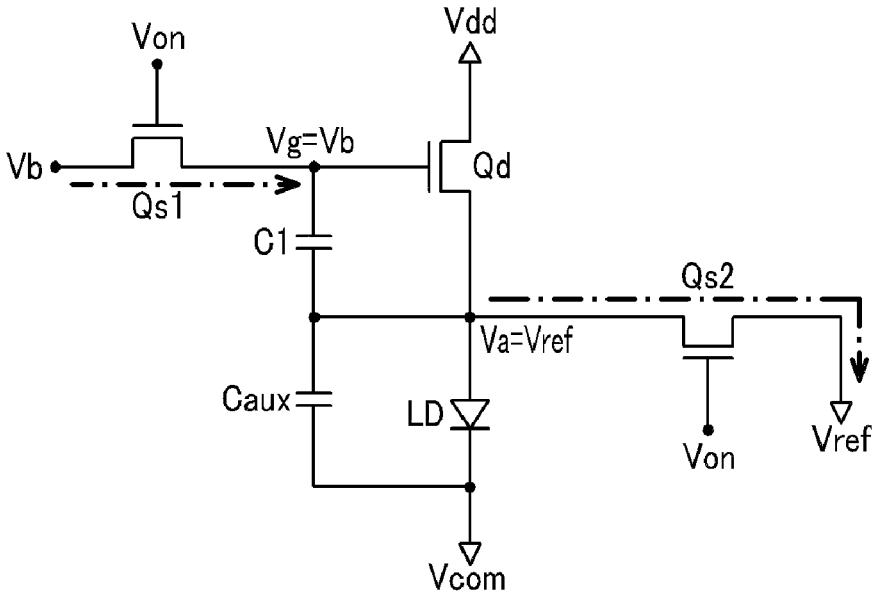

Then, as shown in FIG. 6, the anode voltage Va of the organic light emitting element LD drops to the reference voltage Vref and the driving transistor Qd is turned on. At this time, the reference voltage Vref may be set to the magnitude at which the driving transistor Qd can be turned on by a difference Vb-Vref between the black voltage Vb and the reference voltage Vref The reference voltage Vref may be set to the same voltage as the common voltage Vcom, for example 0V.

At this time, the anode voltage Va drops while discharging an auxiliary capacitance component Caux that primarily exists in the organic light emitting element LD. The auxiliary capacitance component Caux may be a capacitance component that is formed by electrodes constituting the organic light emitting element LD. In a case when the auxiliary capacitance component Caux is large and the current driving performance of the switching transistor Qs2 is low, the pull-down driver 700 sets the pull-down period TA2 to 1 horizontal period (also referred to as "1H" that may be the same as one cycle of the horizontal synchronization signal Hsync) or more to allow the anode voltage Va to sufficiently drop to the reference voltage Vref.

Meanwhile, light emitting interruption may be performed simultaneously in the pull-down period TA2. In this case, the light emitting interruption period TA1 may be eliminated.

After the node voltage Va drops to the reference voltage Vref, the pull-down driver 700 turns off the switching transistor Qs2 by converting the pull-down signal $Vp_i$ into the low voltage Voff to start a compensation period TA3. Even in this period TA3, the scan signal $Vg_i$ maintains the high voltage Von and the black voltage Vb is continuously applied to the data line $D_j$. As a result, when the compensation period TA3 is started, the driving transistor Qd is maintained to be turned on.

Figure 7:
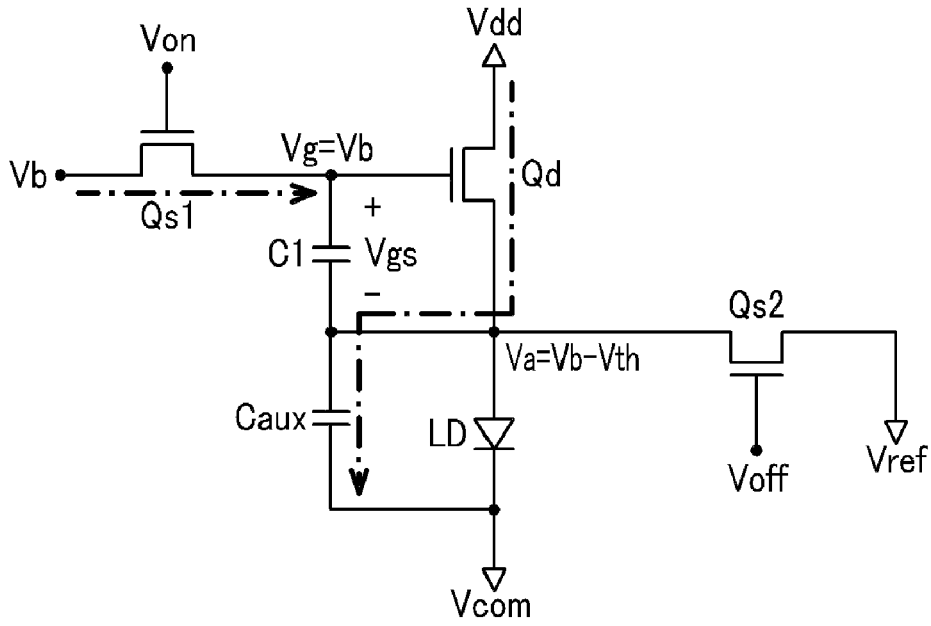

Therefore, as shown in FIG. 7, an output current Ild of Equation 1 flows to the anode of the organic light emitting element LD from the driving voltage line through the turned-on driving transistor Qd, and the auxiliary capacitance component Caux which exists in the organic light emitting element LD is charged with the output current Ild. Therefore, the anode voltage Va of the organic light emitting element LD increases, such that a gate-source voltage Vgs of the driving transistor Qd decreases and the output current Ild that flows through the driving transistor Qd decreases. When the gate-source voltage Vgs drops and is equal to the threshold voltage Vth of the driving transistor Qd, the driving transistor Qd is turned off, whereby the output current Ild stops flowing and the anode voltage Va stops increasing. Accordingly, the threshold voltage Vth of the driving transistor Qd is stored in the capacitor C1. When the current driving performance of the driving transistor Qd is low, the output current Ild that flows through the driving transistor Qd decreases, such that the threshold voltage Vth may not be stored in the capacitor C1 within a short time. In this case, the pull-down driver 700 allows the threshold voltage Vth to be sufficiently stored in the capacitor C1 by setting the compensation period TA3 to 1H or more.

$$Ild=\tfrac{1}{2}*k*(Vgs-Vth)^2=\tfrac{1}{2}*k*(Vb-Va-Vth)^2 \qquad \text{Equation 1}$$

Herein, k is a constant according to a characteristic of the driving transistor Qd. $k=\mu C_{SiNx}(W/L)$, wherein $\mu$ represents a field effect mobility, $C_{SiNx}$ represents a capacitance of an insulating layer, W represents a channel width of the driving transistor Qd, and L represents a channel length of the driving transistor Qd.

In a case in which the capacitor C1 is charged with the threshold voltage Vth, the anode voltage Va of the organic light emitting element LD satisfies Equation 2 and the voltage Vld of the organic light emitting element LD satisfies Equation 3. When the common voltage Vcom is set so that the voltage Vld of the organic light emitting element LD is smaller than the turn-on voltage Vto of the organic light emitting element LD, the organic light emitting element LD may not emit the light during this period TA3.

$$Va=Vb-Vth \quad \text{Equation 2}$$

$$Vld=Vb-Vth-Vcom \quad \text{Equation 3}$$

Figure 8:
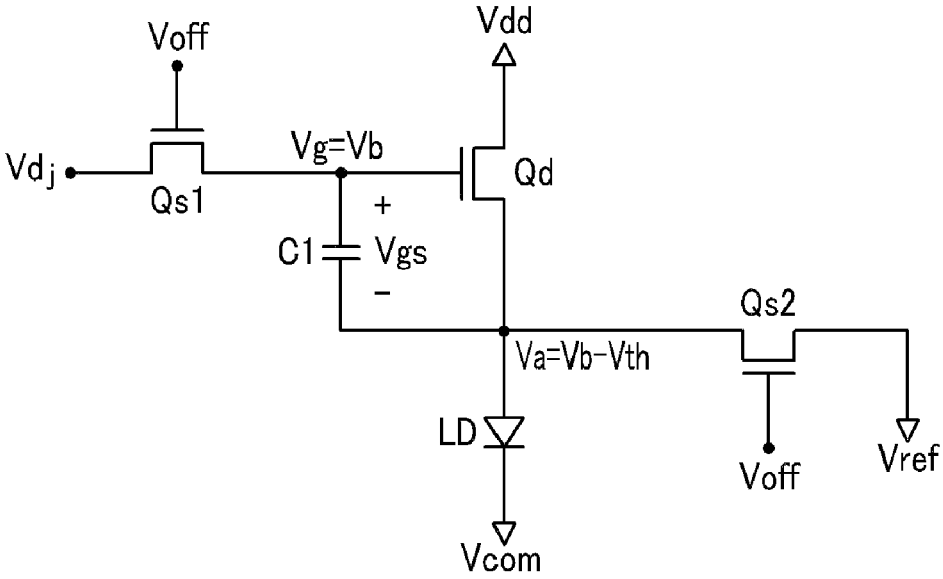

After the threshold voltage Vth of the driving transistor Qd is stored in the capacitor C1, the scan driver 400 turns off the switching transistor Qs1 by converting the scan signal $Vg_i$ into the low voltage Voff to start a stand-by period TA4. The image field Fl2 is started during the stand-by period TA4. Accordingly, the data signal $Vd_j$ is converted into the gray voltage Vdata to be applied to a pixel PX in the corresponding row. However, as shown in FIG. 8, since the switching transistors Qs1 and Qs2 are both turned off in this period TA4, the threshold voltage Vth is continuously stored in the capacitor C1 even though the voltage applied to the data line $D_j$ is changed.

Meanwhile, in the stand-by period TA4, a leakage current may flow through the driving transistor Qd. However, since the leakage current may flow even in the turned-off switching transistor Qs2, the leakage current of the driving transistor Qd flows in the reference voltage line through the switching transistor Qs2, thereby preventing the organic light emitting element LD from emitting the light due to the leakage current. In this case, the low voltage Voff of the pull-down signal $Vp_i$ may be set to a higher value or the reference voltage Vref may be set to a lower value so that the leakage current can be completely discharged through the switching transistor Qs2.

Next, in a write period TA5, the data driver 500 applies the data signal $Vd_j$ having the gray voltage Vdata corresponding to a gray to be display in the pixel PX to the data line $D_j$. The scan driver 400 converts the scan signal $Vg_i$ into the high voltage Von to turn on the switching transistor Qs1 again at the time of the write period TA5 or after a predetermined time elapses from the write period TA5.

Figure 9:
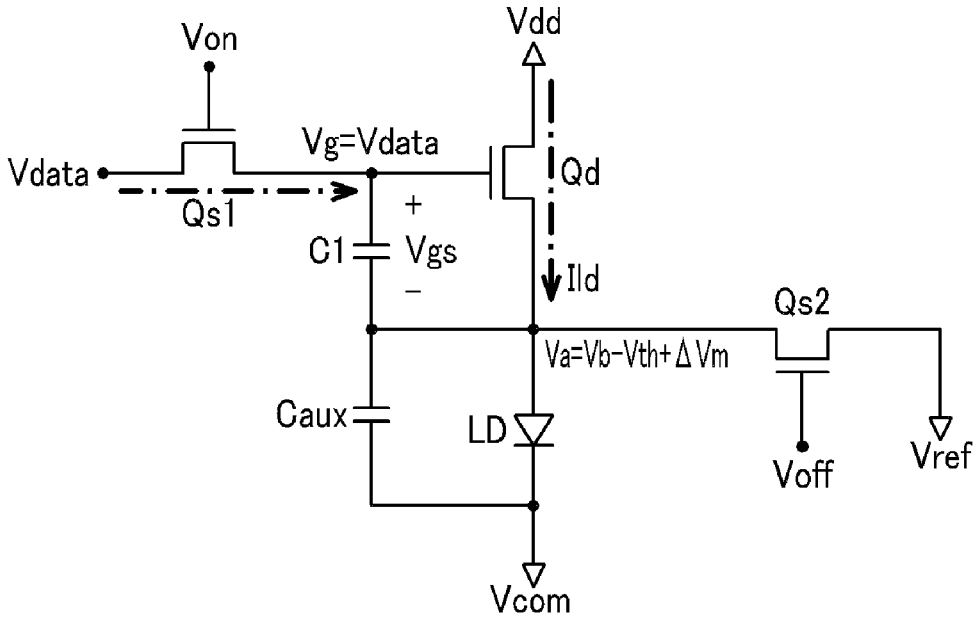

As a result, as shown in FIG. 9, the control terminal of the driving transistor Qd is connected to the gray voltage Vdata and thus the control terminal voltage Vg rises up to the gray voltage Vdata. Meanwhile, since the capacitance of the auxiliary capacitance component Caux of the organic light emitting element LD is still larger than the capacitance of the capacitor C1, the anode voltage Va of the organic light emitting element LD does not almost rise by the auxiliary capacitance component Caux. That is, the anode voltage Va of the organic light emitting element LD substantially maintains the voltage of Equation 2. Accordingly, at the time when the gray voltage Vdata is applied to the control terminal of the driving transistor Qd, the gate-source voltage Vgs of the driving transistor Qd is as shown in Equation 4.

$$Vgs=V\text{data}-(Vb-Vth) \quad \text{Equation 4}$$

The driving transistor Qd is turned on by the gate-source voltage Vgs, such that the output current Ild flows through the driving transistor Qd and the anode voltage Va of the organic light emitting element LD rises by the output current Ild. At this time, a rising voltage amount ΔVm is proportional to the field effect mobility μ of the driving transistor Qd. As a result, the gate-source voltage Vgs is as shown in Equation 5. The output current Ild supplied from the driving transistor Qd to the organic light emitting element LD satisfies Equation 6, and the organic light emitting element LD starts to emit the light by the output current Ild.

$$Vgs=V\text{data}-Vb+Vth-\Delta Vm \quad \text{Equation 5}$$

$$Ild=\tfrac{1}{2}*k*(Vgs-Vth)^2=\tfrac{1}{2}*k*(V\text{data}-Vb-\Delta Vm)^2 \quad \text{Equation 6}$$

In accordance with Equation 6, the output current Ild is not influenced by the threshold voltage Vth of the driving transistor Qd. That is, even if a deviation in the threshold voltage between the driving transistors Qd is generated in the display panel 300, the output current Ild is not influenced by the deviation. When the field effect mobility μ is high, k of Equation 6 increases and ΔVm also increases. Therefore, an influence caused by the increase of k may be compensated by ΔVm. That is, even if the deviation in the threshold voltage between the driving transistors Qd is generated in the display panel 300, the deviation may be compensated by ΔVm.

Figure 10:
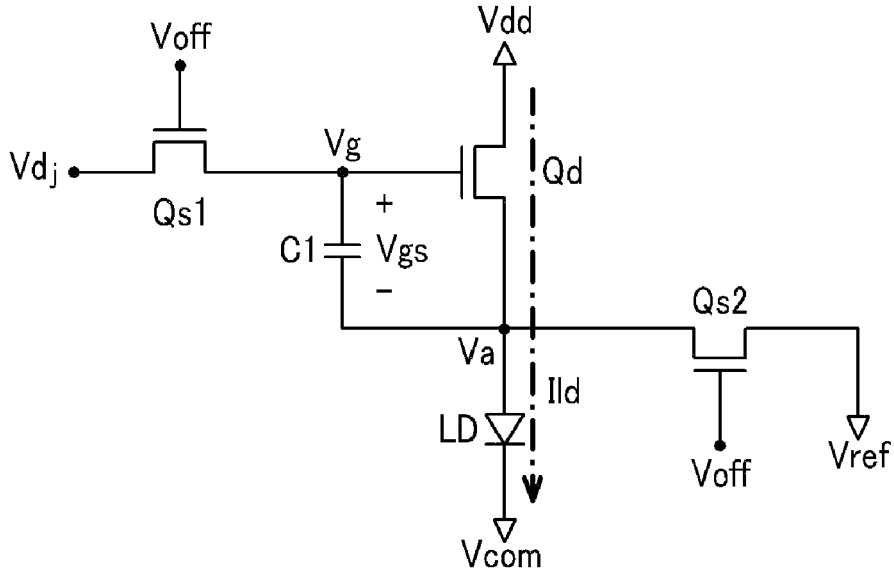

As described above, after the gray voltage Vdata is written in the capacitor C1, the scan driver 400 instantly turns off the switching transistor Qs1 by converting the scan signal $Vg_i$ into the low voltage Voff to start a light emitting period TA6. In this period TA6, the anode voltage Va of the organic light emitting element LD may increase by the output current Ild that flows in the organic light emitting element LD. However, as the anode voltage Va increases by the capacitor C1, the control terminal voltage Vg of the driving transistor Qd increases, and thus the gate-source voltage Vgs of the driving transistor Qd is maintained. That is, even though the organic light emitting element LD deteriorates and thus an increase amount of the anode voltage Va increases, the gate-source voltage Vgs may be constant. Accordingly, as shown in FIG. 10, the output current Ild of Equation 6 is continuously supplied to the organic light emitting element LD, such that the organic light emitting element LD emits the light at a gray corresponding to the gray voltage Vdata.

Since the output current Ild of Equation 6 does not depend on the driving voltage Vdd and the common voltage Vcom, it is possible to maintain the same brightness with respect to the same gray voltage even though the driving voltage Vdd or the common voltage Vcom is different for each pixel by the current that flows through the driving voltage line.

The light emitting period TA6 may be continued until the scan signal $Vg_i$ is converted into the high voltage Von and thus the light emitting interruption period TA1 is started in the next frame.

Next, an organic light emitting display according to another exemplary embodiment of the present invention will be described in detail with reference to FIG. 11 and FIG. 12.

Figure 11:
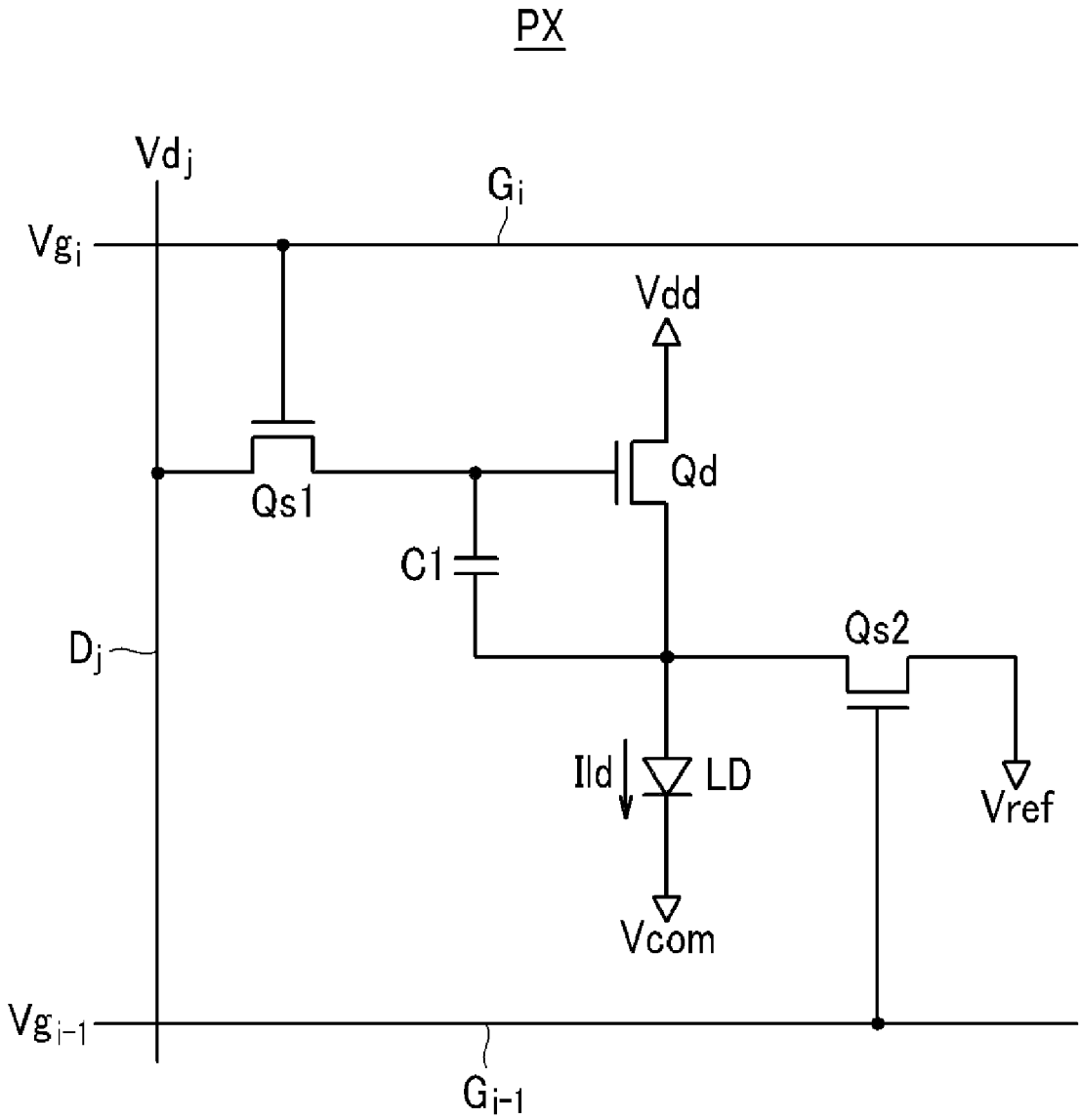
FIG. 11, FIG. 15, FIG. 17, FIG. 19, FIG. 21, and FIG. 25 are equivalent circuit diagrams of one pixel in an organic light emitting display according to another exemplary embodiment of the present invention.
Figure 12:
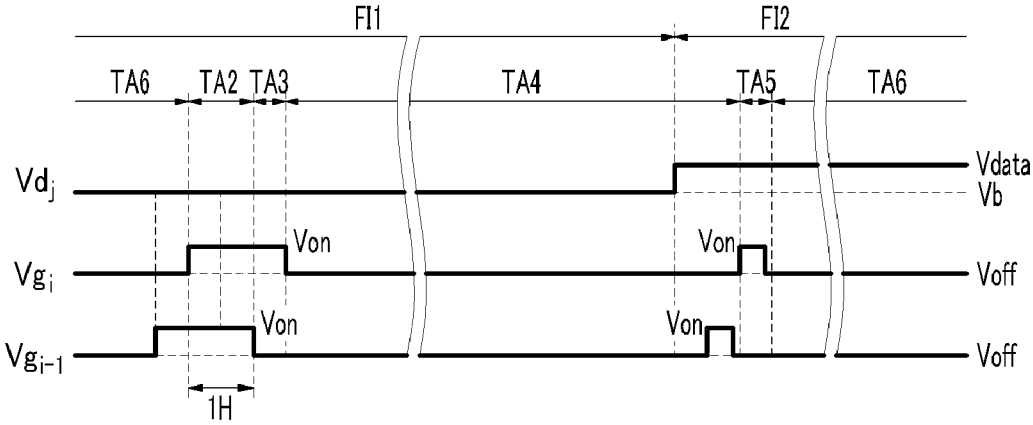
FIG. 12, FIG. 13, FIG. 14, FIG. 16, FIG. 18, FIG. 20, and FIG. 26 are examples of a timing diagram of a driving signal of one pixel in an organic light emitting display according to another exemplary embodiment of the present invention.

FIG. 11 is an equivalent circuit diagram of one pixel in an organic light emitting display according to another exemplary embodiment of the present invention, and FIG. 12 is an example of a timing diagram of a driving signal of one pixel in an organic light emitting display according to the other exemplary embodiment of the present invention.

Referring to FIG. 11 and FIG. 12, in the organic light emitting display according to another exemplary embodiment of the present invention, a scan signal $Vg_{i-1}$ of a previous scan line $G_{i-1}$ may be applied to the control terminal of the switching transistor Qs2.

Therefore, in the black field Fl1, a period, during which the scan signals $Vg_{i-1}$ and $Vg_i$ of both the previous scan line $G_{i-1}$ and the current scan line $G_i$ have the high voltage Von, corresponds to the pull-down period TA2, and a period, during which the scan signal $Vg_{i-1}$ of the previous scan line $G_{i-1}$ has the low voltage Voff while the scan signal $Vg_i$ maintains the high voltage Von, corresponds to the compensation period TA3. In this case, the light-emission of the organic light emitting element LD is interrupted in the pull-down period TA2.

Meanwhile, in the stand-by period TA4, the switching transistor Qs2 may be turned on by the high voltage Von applied to the scan signal $Vg_{i-1}$ of the previous scan line $G_{i-1}$. Therefore, as described by referring to FIG. 5, the anode voltage Va of the organic light emitting element LD drops such that the threshold voltage Vth stored in the capacitor C1 may be changed. In order to prevent the threshold voltage Vth from being changed, it is possible to reduce a change of the capacitor C1 voltage by designing the current driving performance of the switching transistor Qs2 to be lower, for example, a channel width of the switching transistor Qs2 to be shorter or a channel length of the switching transistor Qs2 to be longer. In the case of designing the current driving performance of the switching transistor Qs2 to be lower, it is possible to set a period during which the scan signals $Vg_{i-1}$ and $Vg_i$ have the high voltage Von in the black field Fl1 to be longer so that the anode voltage Va can sufficiently drop in the pull-down period TA2.

In the above-mentioned exemplary embodiment, one frame is divided into the plurality of fields Fl1 and Fl2, the data signal having the black voltage Vb is applied to the plurality of data lines $D_1$-$D_m$ in the black field Fl1, and the data signal having the gray voltage is applied to the plurality of data lines $D_1$-$D_m$ in the image field Fl2. Unlike this, the black voltage Vb may be applied in different forms in one frame. The exemplary embodiments will now be described in detail with reference to FIG. 13, FIG. 14, FIG. 15, FIG. 16, FIG. 17, FIG. 18, FIG. 19, FIG. 20, and FIG. 21.

Figure 13:
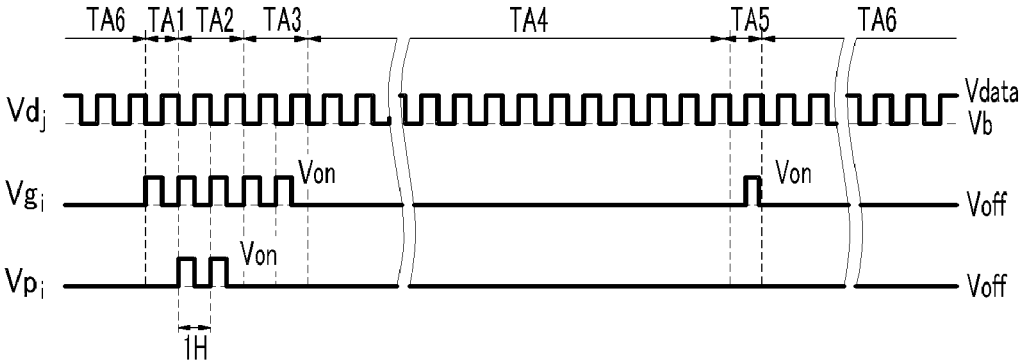
Figure 14:
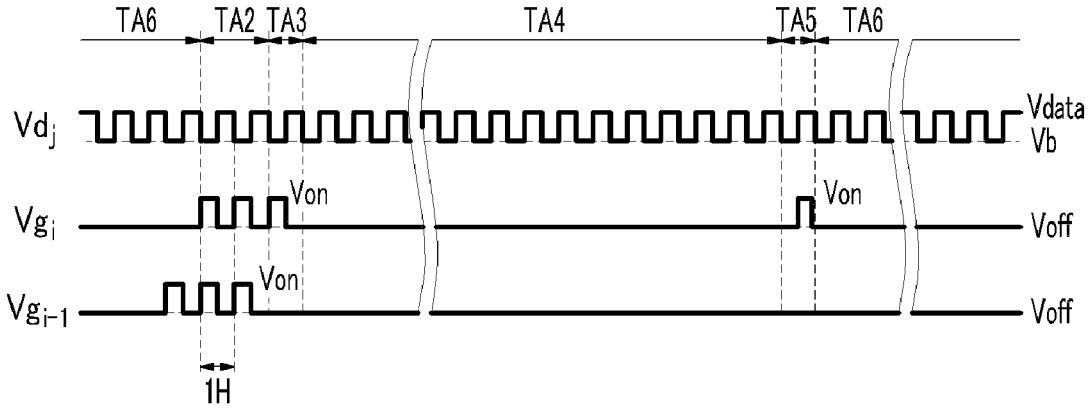

FIG. 13 and FIG. 14 are examples of a timing diagram of one pixel in an organic light emitting display according to yet another exemplary embodiment of the present invention. For example, the timings of the driving signal, which are shown in FIG. 13 and FIG. 14, may be applied to the pixels PX shown in FIG. 2 and FIG. 11, respectively.

Referring to FIG. 13, the data signal $Vd_j$ alternately has the black voltage Vb and the gray voltage Vdata at a predetermined cycle, for example at a cycle of 1H. As an example, the data signal $Vd_j$ may have the black voltage during the previous period H/2 and the gray voltage Vdata during the subsequent period H/2.

The scan signal $Vg_j$ has the high voltage Von while the data signal $Vd_j$ has the black voltage Vb in the light emitting interruption period TA1, the pull-down period TA2, and the compensation period TA3, and has the high voltage Von while the data signal $Vd_j$ has the gray voltage Vdata in the write period TA5.

As a result, while the scan signal $Vg_i$ has the high voltage Von in the light emitting interruption period TA1, the control terminal voltage Vg of the driving transistor Qd becomes the black voltage Vb, and thus the driving transistor Qd is turned off.

While both the scan signal $Vg_i$ and the pull-down signal $Vp_i$ have the high voltage Von in the pull-down period TA2, the anode voltage Va of the organic light emitting element LD of the pixel PX drops. In the compensation period TA3, while the scan signal $Vg_i$ has the high voltage Von and the pull-down signal $Vp_i$ has the low voltage Voff, the threshold voltage Vth is stored in the capacitor C1 of the pixel PX. In this case, in the pull-down period TA2, the scan signal $Vg_i$ increases the number of times to have the high voltage Von to sufficiently drop the anode voltage Va.

Next, in the write period TA5, while the scan signal $Vg_i$ has the high voltage Von, the gray voltage Vdata is applied to the data line $D_j$ and the gray voltage Vdata is stored in the capacitor C1 of the pixel PX together with the threshold voltage Vth. Accordingly, the pixel PX emits the light in the write period TA5 and the light emitting period TA6.

In this case, a length of the stand-by period TA4 between the compensation period TA3 and the write period TA5 may be set to a half of one frame or less.

Meanwhile, referring to FIG. 14, the scan signal $Vg_i$ shown in FIG. 13 may be applied to the pixel PX shown in FIG. 11.

Figure 15:
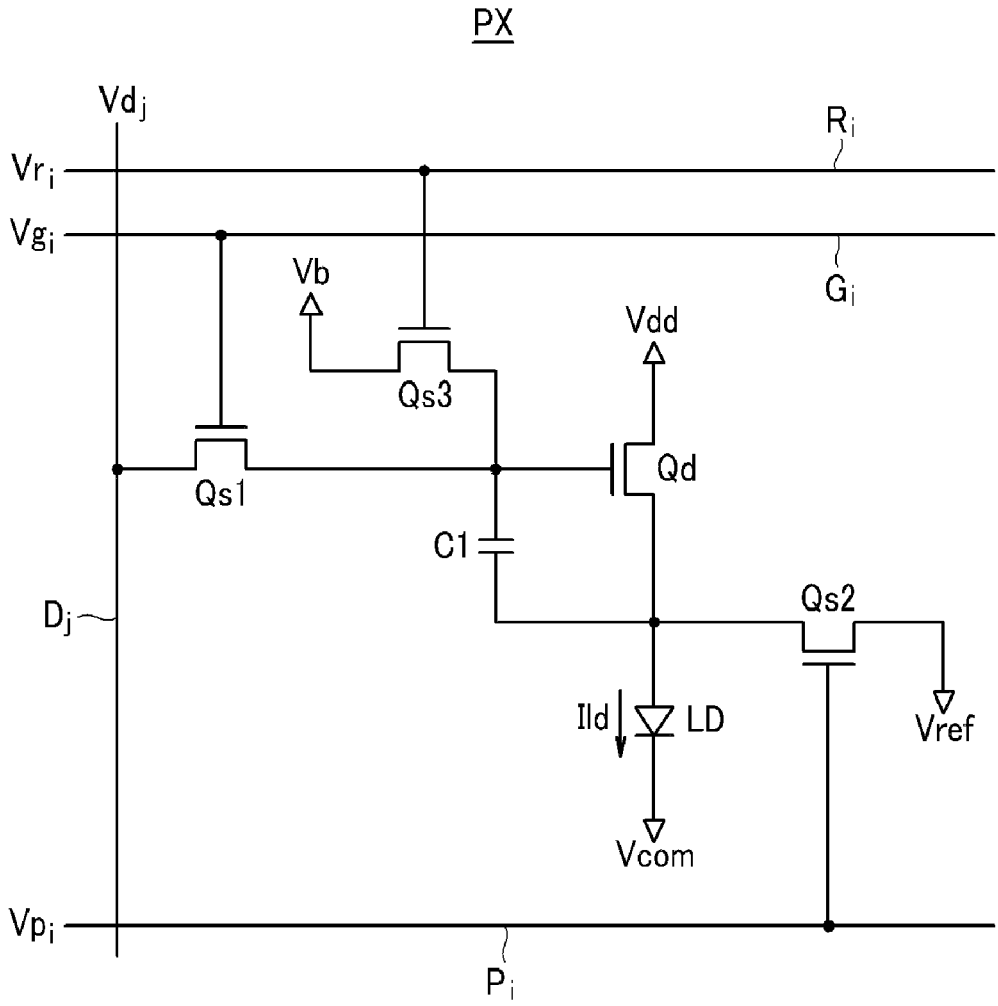
Figure 16:
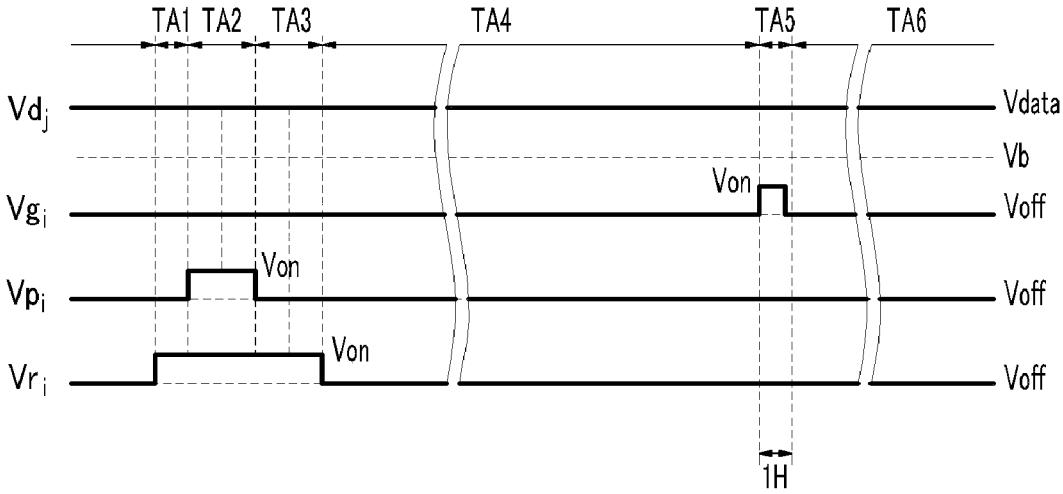

FIG. 15 is an equivalent circuit diagram of one pixel in an organic light emitting display according to yet another exemplary embodiment of the present invention, and FIG. 16 is an example of a timing diagram of a driving signal of one pixel in an organic light emitting display according to yet another exemplary embodiment of the present invention.

Referring to FIG. 15, one pixel PX further includes a switching transistor Qs3 for transmitting the black voltage Vb, and the organic light emitting display further includes an initialization signal line $R_i$. The initialization signal line $R_i$ extends in a row direction and transmits an initialization signal $Vr_i$ as a control signal for controlling the operation of the pixel PX. An input terminal of the switching transistor Qs3 is connected to a black voltage line (not shown) for transmitting the black voltage Vb, an output terminal of the switching transistor Qs3 is connected to the control terminal of the driving transistor Qd, and the control terminal of the switching transistor Qs3 is connected to the initialization signal line $R_i$. The switching transistor Qs3 transmits the black voltage Vb in response to the high voltage Von of the initialization signal $Vr_i$.

Referring to FIG. 16, the initialization signal $Vr_i$ has the high voltage Von in the light emitting interruption period TA1, the pull-down period TA2, and the compensation period TA3. As a result, during the periods TA1, TA2, and TA3, since the black voltage Vb is applied to the control terminal of the driving transistor Qd, the pixel PX may operate similarly as described in FIG. 4, FIG. 5, FIG. 6, and FIG. 7.

In this exemplary embodiment, since the black voltage Vb can be transmitted to the control terminal of the driving transistor Qd even though the scan signal $Vg_i$ has the low voltage Voff, one frame may not be divided into the plurality of fields. Accordingly, the scan signal $Vg_i$ may have the high voltage Von for 1H or the high voltage Von during a period shorter than 1H by being limited by an output enable signal OE in the write period TA5. In this case, the data signal $Vd_i$ has the gray voltage Vdata corresponding to the digital image signal DAT of the pixel PX to which the scan signal $Vg_i$ having the high voltage Von is applied every period of 1H.

In this exemplary embodiment, the stand-by period TA4 may be also set to a half of one frame or less.

Figure 17:
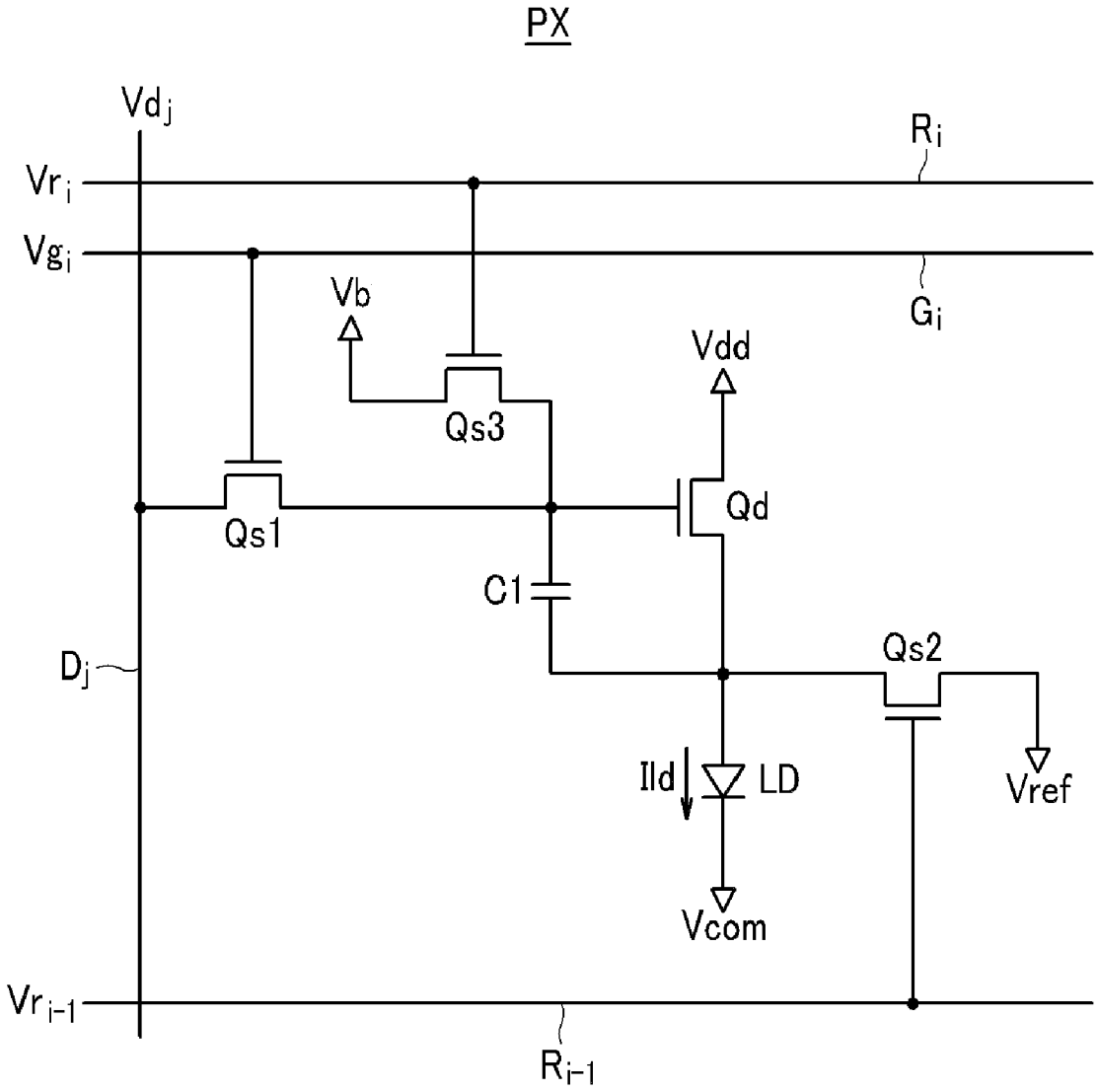
Figure 18:
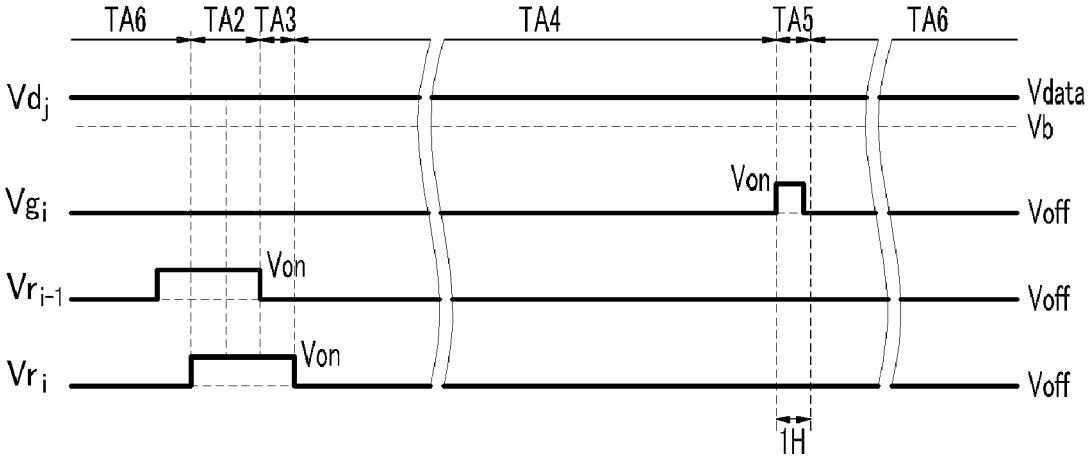

FIG. 17 is an equivalent circuit diagram of one pixel in an organic light emitting display according to yet another exemplary embodiment of the present invention, and FIG. 18 is an example of a timing diagram of a driving signal of one pixel in an organic light emitting display according to yet another exemplary embodiment of the present invention.

Referring to FIG. 17 and FIG. 18, in the organic light emitting display according to yet another exemplary embodiment of the present invention, an initialization signal $Vr_{i-1}$ of the previous initialization signal line $R_{i-1}$ may be applied to the control terminal of the switching transistor Qs2.

Therefore, a period, during which the initialization signal lines $Vr_{i-1}$ and $Vr_i$ of both initialization signal lines $R_{i-1}$ and $R_i$ have the high voltage Von, corresponds to the pull-down period TA2, and a period, during which the initialization signal $Vr_{i-1}$ of the previous initialization signal line $R_{i-1}$ has the low voltage Voff while the initialization signal $Vr_i$ of the initialization signal line $R_i$ has the high voltage Von, corresponds to the compensation period TA3.

Figure 19:
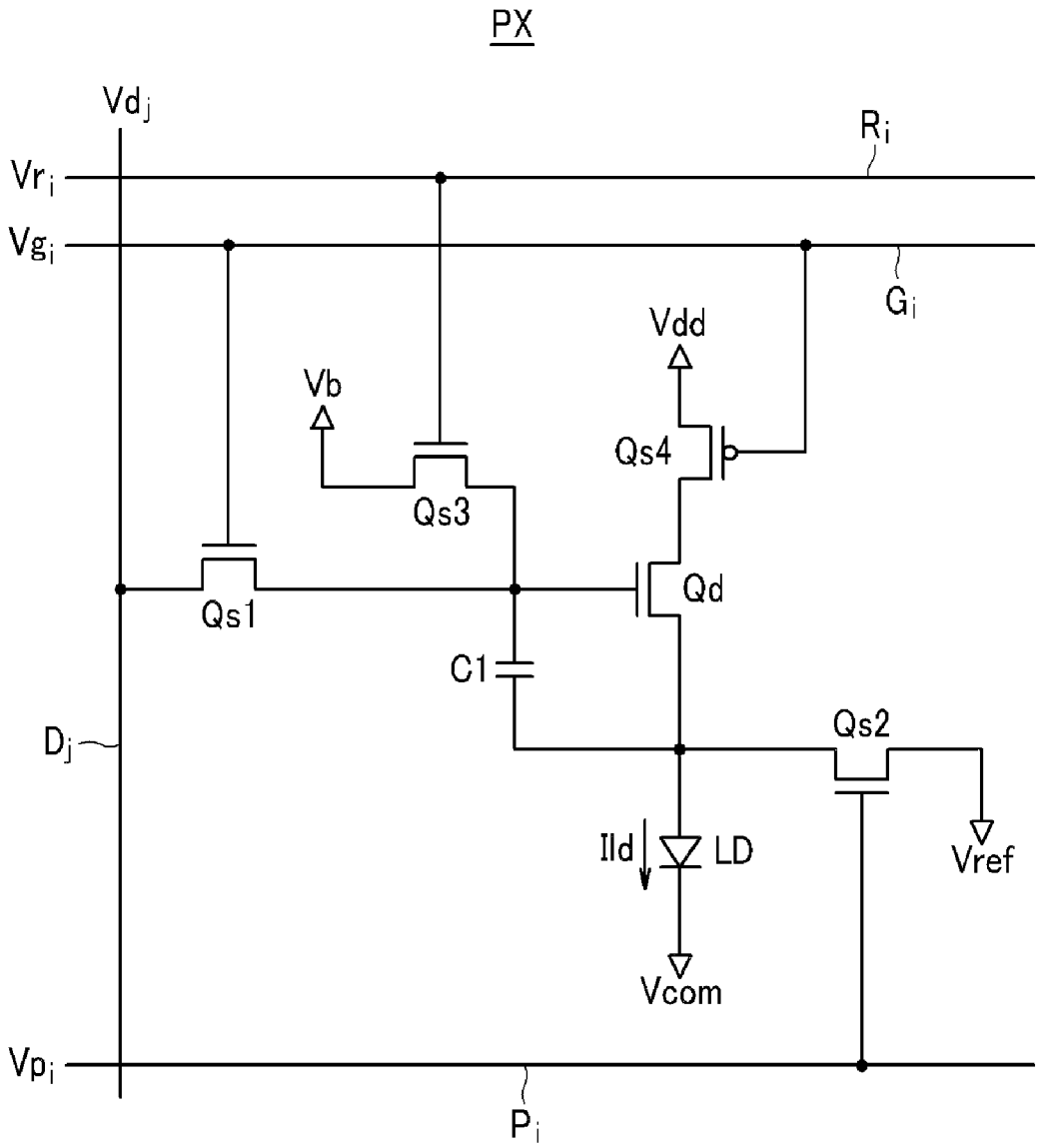
Figure 20:
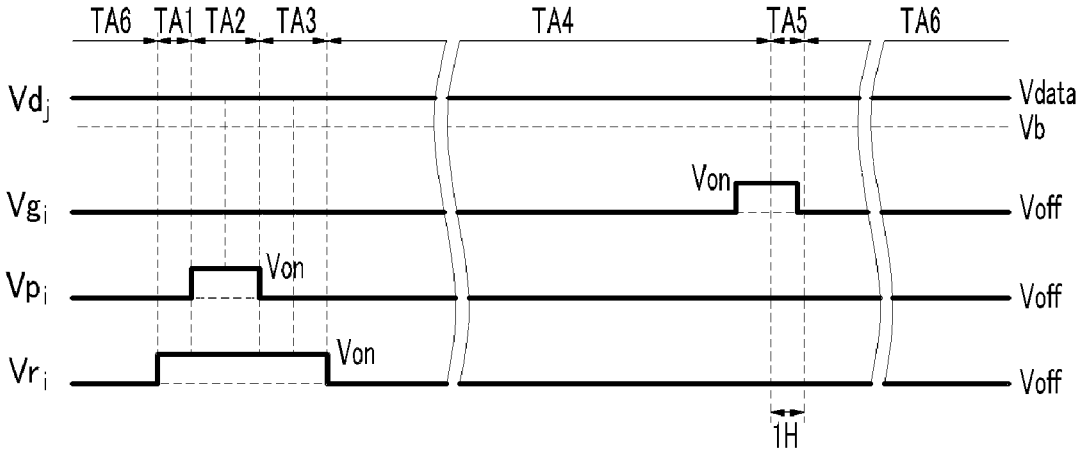
Figure 21:
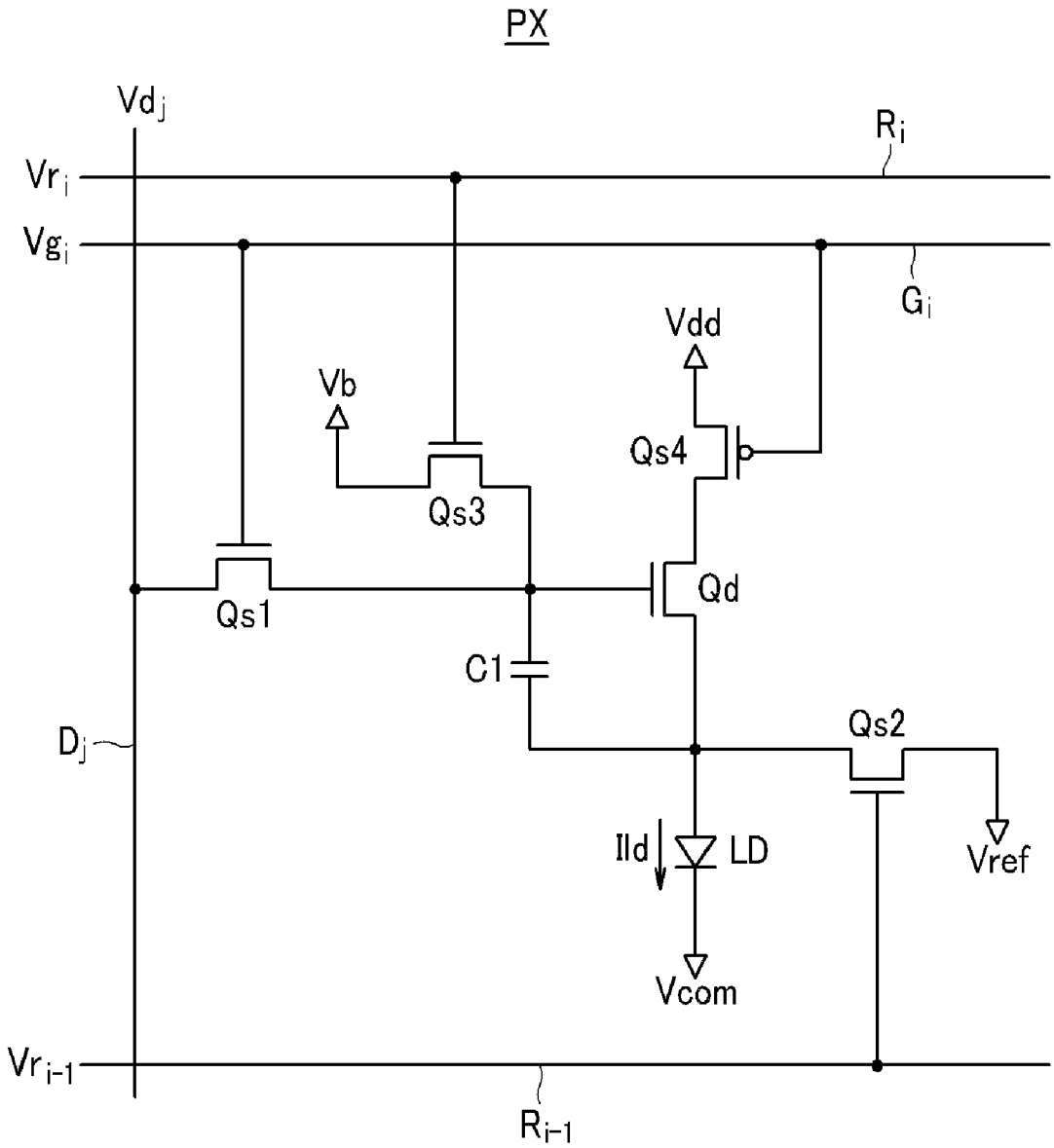

FIG. 19 and FIG. 21 are equivalent circuit diagrams of one pixel in an organic light emitting display according to yet another exemplary embodiment of the present invention, and FIG. 20 is an example of a timing diagram of a driving signal of one pixel in an organic light emitting display according to yet another exemplary embodiment of the present invention.

Referring to FIG. 19, one pixel PX further includes a switching transistor Qs4 for controlling light-emission of the organic light emitting element LD. An input terminal of the switching transistor Qs4 is connected to the driving voltage line, an output terminal of the switching transistor Qs4 is connected to the input terminal of the driving transistor Qd, and a control terminal of the switching transistor Qs4 is connected to the scan line $G_i$. The switching transistor Qs4 has a channel type that is different from the switching transistor Qs1. For example, the switching transistor Qs4 may be a p-channel field effect transistor.

Referring to FIG. 20, in the write period TA5, the switching transistor Qs1 transmits the gray voltage Vdata to the control terminal of the driving transistor Qd in response to the high voltage Von of the scan signal $Vg_i$, and the switching transistor Qs4 separates the driving transistor Qd from the driving voltage Vdd in response to the high voltage Von of the scan signal $Vg_i$. As a result, since the output current Ild does not flow in the driving transistor Qd in the write period TA5, the gate-source voltage Vgs of Equation 4 is stored in the capacitor C1.

In this case, a period during which the scan signal $Vg_i$ has the high voltage may be set to 1H or more, and a period during which the data signal $Vd_j$ has the gray voltage Vdata corresponding to the digital image signal DAT of the pixel PX connected to the scan line Gi may be set to 1H or a period shorter than 1H. As a result, even though a period when the scan signal $Vg_i$ has the high voltage is delayed, the gray voltage Vdata may be sufficiently stored in the capacitor C1 by a parasitic component formed on the scan line $G_i$.

Subsequently, in the light emitting period TA6, the switching transistor Qs4 connects the driving transistor Qd to the driving voltage Vdd in response to the low voltage Voff of the scan signal $Vg_i$ and thus the driving transistor Qd is turned on by the gate-source voltage Vgs stored in the write period TA5, such that the output current Ild flows through the driving transistor Qd and the organic light emitting element LD emits the light by the output current Ild.

Referring to FIG. 21, in the pixel PX shown in FIG. 19, the initialization signal $Vr_{i-1}$ of the previous initialization signal line $R_{i-1}$ may be applied to the control terminal of the switching transistor Qs2.

Figure 22:
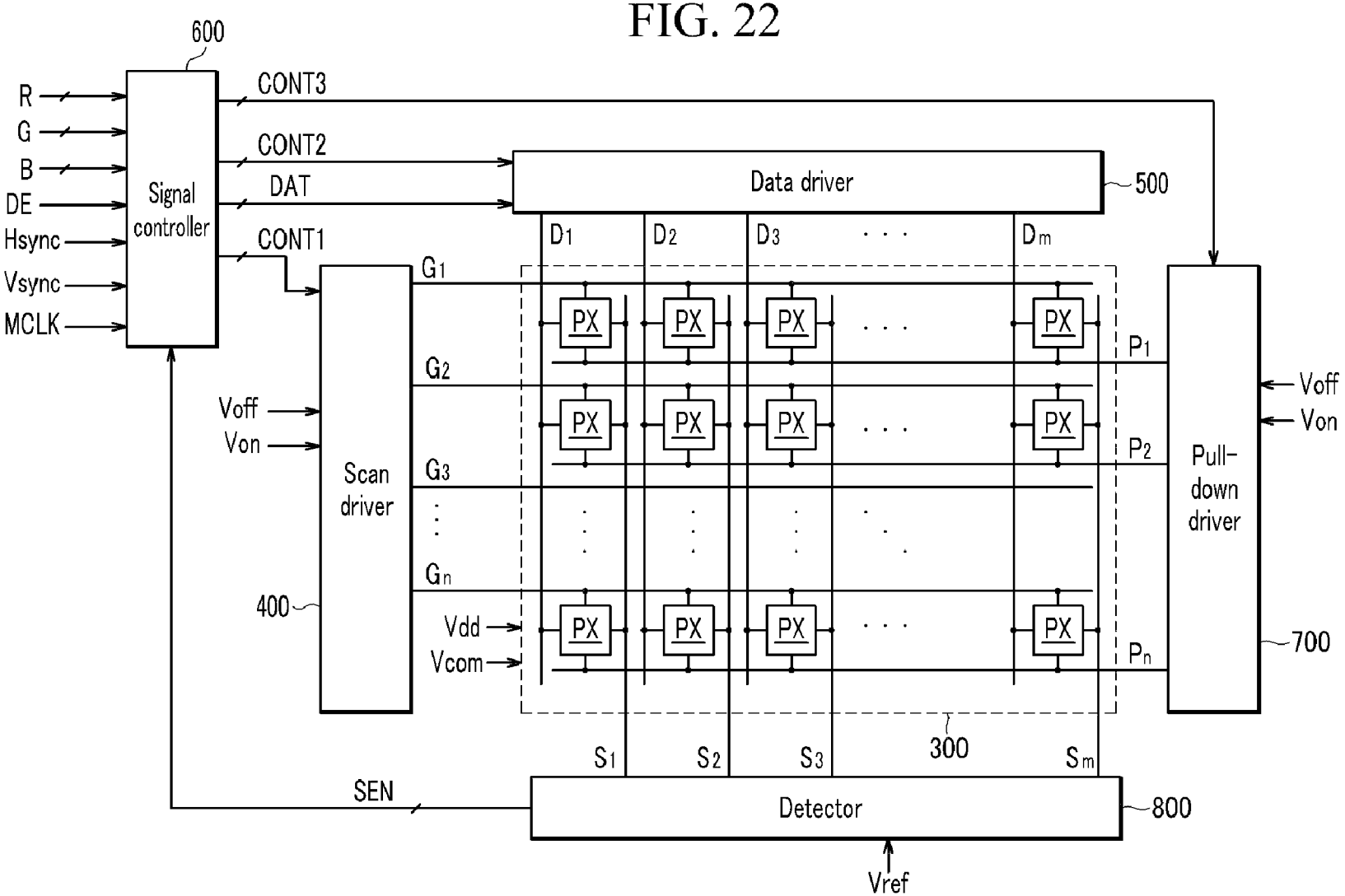
FIG. 22 is a block diagram of an organic light emitting display according to yet another exemplary embodiment of the present invention.
Figure 23:
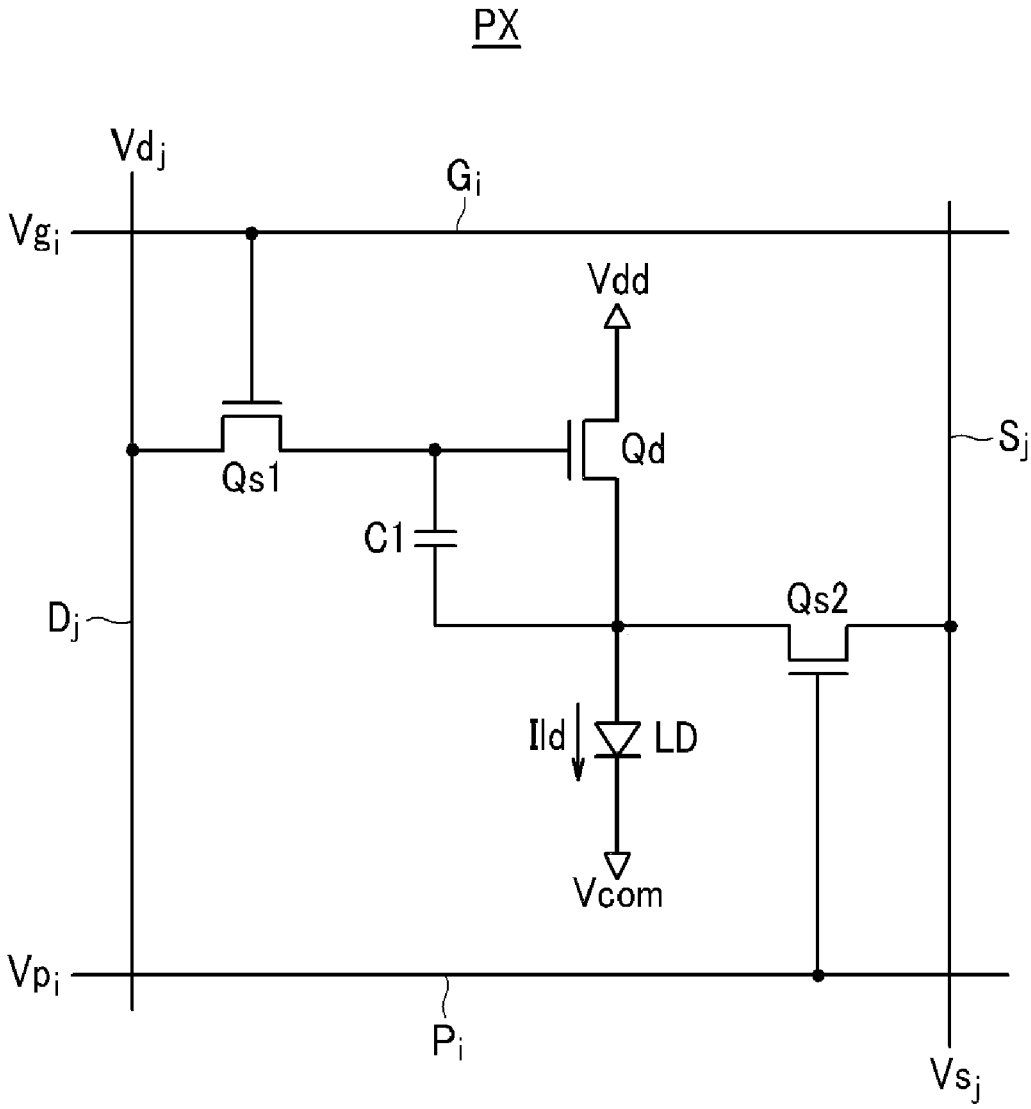
FIG. 23 is an equivalent circuit diagram of one pixel in an organic light emitting display according to yet another exemplary embodiment of the present invention.
Figure 24:
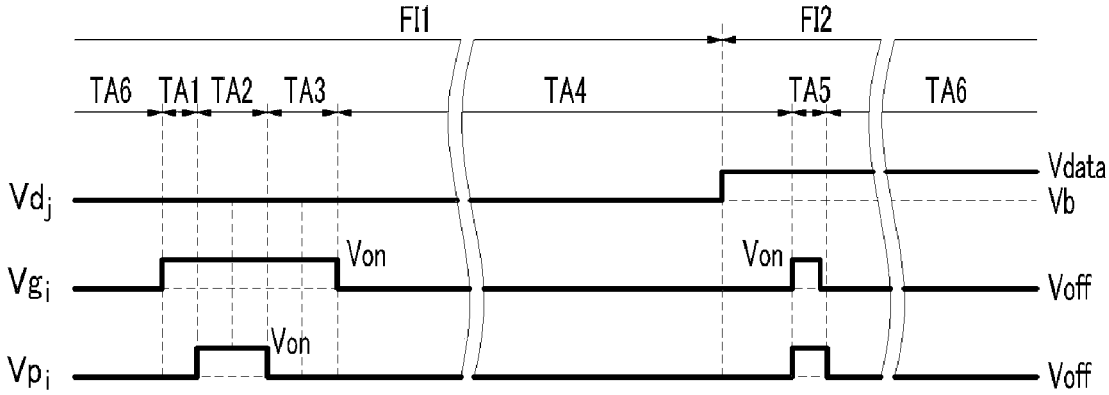
FIG. 24 is a timing diagram of a driving signal of an organic light emitting display in a non-display period according to yet another exemplary embodiment of the present invention.

Meanwhile, the organic light emitting display according to yet another exemplary embodiment detects the deterioration of the organic light emitting element LD to compensate the deterioration thereof. The exemplary embodiment will now be described in detail with reference to FIG. 22, FIG. 23, and FIG. 24. In FIG. 22, FIG. 23, and FIG. 24, the pixel PX shown in FIG. 2 is described as an example. Similarly, even in the pixels of the above-mentioned exemplary embodiments, it is possible to compensate the deterioration of the organic light emitting element LD.

FIG. 22 is a block diagram of an organic light emitting display according to yet another exemplary embodiment of the present invention, FIG. 23 is an equivalent circuit diagram of one pixel in an organic light emitting display according to yet another exemplary embodiment of the present invention, and FIG. 24 is a timing diagram of a driving signal in a non-display period of an organic light emitting display according to yet another exemplary embodiment of the present invention.

Referring to FIG. 22 and FIG. 23, the organic light emitting display according to yet another exemplary embodiment of the present invention may further include a detector 800, and the display panel 300 may further include detection signal lines $S_1$-$S_m$.

The detection signal lines $S_1$-$S_m$ extend in the column direction and are substantially parallel to each other. In one pixel PX, for example a pixel PX connected to a j-th data line $D_j$, the input terminal of the switching transistor Qs2 is connected to a j-th detection signal line $S_j$.

The detector 800 is connected to the detection signal lines $S_1$-$S_m$. During an image display period of the organic light emitting display, voltages $Vs_1$-$Vs_m$ of the detection signal lines $S_1$-$S_m$ are set as the reference voltage Vref The detector 800 detects the voltages $Vs_1$-$Vs_m$ of the detection signal lines $S_1$-$S_m$ during the non-display period of the organic light emitting display, converts a detection result into digital detection data SEN, and transmits the digital detection data SEN to the signal controller 600. The signal controller 600 determines the deterioration degree of the organic light emitting element LD in each pixel PX in accordance with the digital detection data SEN. As a result, it is possible to change the gray voltage of the data signals $Vd_1$-$Vd_m$. For example, when the deterioration degree of the organic light emitting element LD in one pixel PX is serious, the signal controller 600 sets the gray voltage of the corresponding pixel PX to a voltage higher than the other pixels with respect to the same gray. The data control signal CONT2 or the image signal DAT generated is thereby transmitted to the data driver 500. In some embodiments, the signal controller 600 determines the deterioration degree of the entire organic light emitting element LD and readjusts a gamma correction curve used for gamma-correcting the input image signals R, G, and B.

Referring to FIG. 24, in the non-display period, for example in an initial driving period of the organic light emitting display, the data driver 500 applies the data signals $Vd_1$-$Vd_m$ having the same gray voltage to the data lines $D_1$-$D_m$ in the image field Fl2.

In the write period TA5, the anode voltage Va of the organic light emitting element LD increases by the output current Ild of the driving transistor Qd. At this time, in a case in which the organic light emitting element LD is deteriorated, a voltage amount ΔVa in which the anode voltage Va rises may depend on the deterioration degree of the organic light emitting element LD in addition to the field effect mobility of the driving transistor Qd.

During this period TA5, the pull-down driver 700 converts the pull-down signal $Vp_i$ into the high voltage Von.

As a result, a voltage Vb−Vth+ΔVa of which the anode voltage Va is transmitted to the detection signal line $S_j$, the detector 800 detects the anode voltage Va through the detection signal line $S_j$, converts the detected anode voltage Va into the digital detection data SEN, and sends the digital detection data SEN to the signal controller 600.

Meanwhile, in the above-mentioned exemplary embodiments, although the n-channel field effect transistor has been exemplified as one example of the switching transistors Qs1-Qs3 and the driving transistor Qd, at least one of the switching transistors Qs1-Qs3 and the driving transistor Qd may be a p-channel field effect transistor. In this case, connection relationships of the switching transistors Qs1-Qs3, the driving transistor Qd, the capacitor C1, and the organic light emitting element LD may be changed.

A case in which the switching transistors Qs1 and Qs2 and the driving transistor Qd are the p-channel field effect transistors will now be described in detail with reference to FIG. 25 and FIG. 26.

Figure 25:
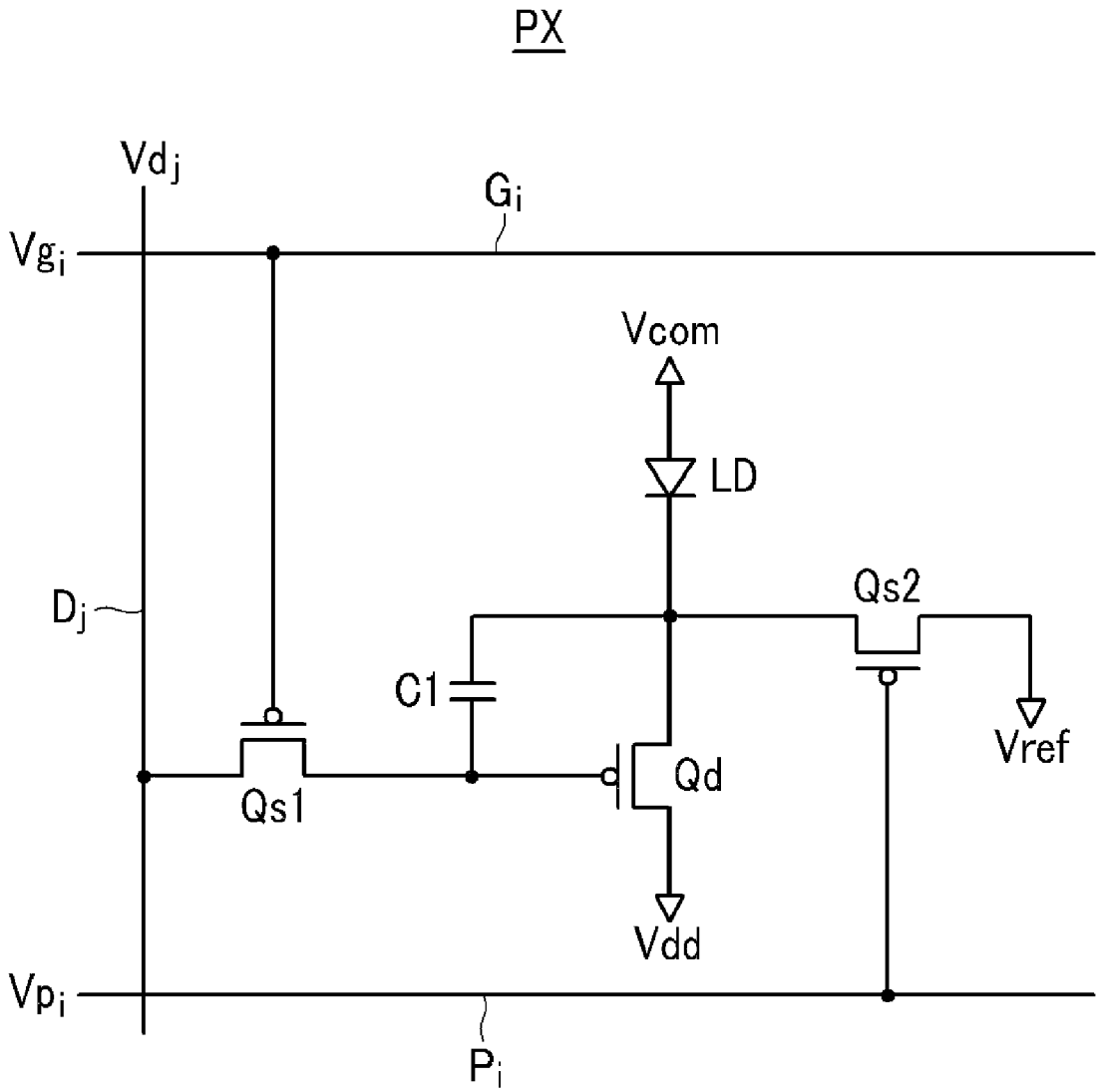
Figure 26:
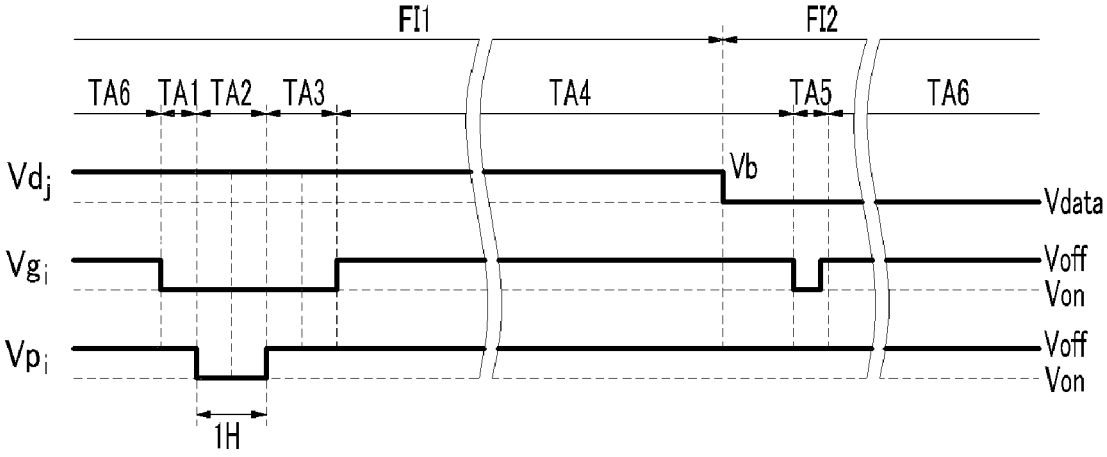

FIG. 25 is an equivalent circuit diagram of one pixel in an organic light emitting display according to yet another exemplary embodiment of the present invention, and FIG. 26 is an example of a timing diagram of a driving signal of one pixel in an organic light emitting display according to the other exemplary embodiment of the present invention.

Referring to FIG. 25, the switching transistors Qs1 and Qs2 and the driving transistor Qd are the p-channel field effect transistors, and the control terminal, the input terminal, and the output terminal of each transistor Qd correspond to the gate, the source, and the drain, respectively.

Unlike the pixel PX shown in FIG. 2, the input terminal of the driving transistor Qd is connected to the cathode of the organic light emitting element LD, and the output terminal of the driving transistor Qd is connected to the driving voltage line for transmitting the driving voltage Vdd. The anode of the organic light emitting element LD is connected to the common voltage Vcom, and the capacitor C1 is connected between the input terminal and the control terminal of the driving transistor Qd. In this case, the driving voltage Vdd is lower than the common voltage Vcom.

Referring to FIG. 26, since the switching transistors Qs1 and Qs2 are the p-channel field effect transistors, the switch-on voltage Von and the switch-off voltage Voff in the scan signal $Vg_i$ and the pull-down signal $Vp_i$ are the low voltage and the high voltage, respectively. The black voltage Vb may be the highest voltage among the plurality of gray voltages Vdata, which corresponds to a gray of a predetermined number, and the reference voltage Vref is higher than the black voltage Vb. Therefore, the pixel PX may operate similar to the pixel PX shown in FIG. 2.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device comprising a plurality of pixels, each pixel comprising:

a light emitting element that comprises a first terminal and a second terminal, the second terminal being connected to a first driving voltage;

a first transistor that comprises a control terminal, a first terminal, and a second terminal, the first transistor to transmit a driving current that corresponds to a voltage between the control terminal and the second terminal to the light emitting element, the second terminal being connected to the first terminal of the light emitting element;

at least one second transistor to transmit a black voltage that corresponds to a black gray to the control terminal of the first transistor in a first period and a second period, and to transmit a gray voltage that corresponds to an input image signal to the control terminal of the first transistor in a third period;

a third transistor connected between the first terminal of the light emitting element and a voltage supply line, to transmit a reference voltage, the third transistor being on in the first period and off in the second period; and a capacitor connected between the control terminal and the second terminal of the first transistor to store a control voltage based on a threshold voltage of the first transistor in the second period and then to store a voltage based on the control voltage and the gray voltage in the third period.

2. The display device of claim 1, wherein the first terminal of the first transistor is connected to a second driving voltage, the second driving voltage being different from the first driving voltage.

3. The display device of claim 2, wherein each pixel further comprises a fourth transistor connected between the first terminal of the first transistor and the second driving voltage, and the fourth transistor is turned off in the third period.

4. The display device of claim 1, wherein, in a fourth period before the first period, the at least one second transistor transmits the black voltage to the control terminal of the first transistor, and the third transistor is off.

5. The display device of claim 1, further comprising:

a first scan line to transmit a first scan signal to a first pixel among the plurality of pixels; and a data line to transmit the black voltage to the first pixel in the first period and the second period, and to transmit the gray voltage to the first pixel in the third period, wherein the first scan signal comprises a switch-on voltage in the first period, the second period, and the third period, and the at least one second transistor of the first pixel further comprises a fourth transistor connected between the data line and the first scan line, and the fourth transistor is turned on in response to the switch-on voltage of the first scan signal.

6. The display device of claim 5, further comprising a second scan line to transmit a second scan signal to a second pixel among the plurality of pixels, wherein the second scan signal comprises the switch-on voltage earlier than the first scan signal, and the third transistor of the first pixel is turned on in response to the switch-on voltage of the second scan signal.

7. The display device of claim 5, wherein one frame includes a first field and a second field, the data line transmits the black voltage that corresponds to pixels connected to the data line among the plurality of pixels in the first field, and the data line transmits the gray voltage that corresponds to the pixels connected to the data line among the plurality of pixels in the second field.

8. The display device of claim 5, wherein the data line alternately transmits the black voltage and the gray voltage, the first scan signal comprises the switch-on voltage multiple times in one frame, the data line transmits the black voltage while the first scan signal comprises the switch-on voltage in the first period and the second period, and the data line transmits the gray voltage while the first scan signal comprises the switch-on voltage in the third period.

9. The display device of claim 1, further comprising:

a scan line to transmit a scan signal to a first pixel among the plurality of pixels;

a first signal line to transmit a first control signal to the first pixel; and a data line to transmit the gray voltage to the first pixel, wherein the at least one second transistor of the first pixel comprises:

a fourth transistor connected between the data line and the scan line, and is turned on in response to a first switch-on voltage of the scan signal; and a fifth transistor connected between the black voltage and the first signal line, and is turned on in response to a second switch-on voltage of the first control signal.

10. The display device of claim 9, further comprising a second signal line to transmit a second control signal to a second pixel among the plurality of pixels, wherein the second control signal comprises the second switch-on voltage earlier than the first control signal, and the third transistor of the first pixel is turned on in response to the second switch-on voltage of the second control signal.

11. The display device of claim 9, wherein each pixel further comprises a sixth transistor connected between the first terminal of the first transistor and the second driving voltage, the second driving voltage being different from the first driving voltage, and the sixth transistor is off in the third period.

12. The display device of claim 11, wherein the sixth transistor of the first pixel is turned off in response to the first switch-on voltage of the scan signal.

13. The display device of claim 11, wherein the scan signal comprises the first switch-on voltage during a period longer than 1 horizontal period.

14. The display device of claim 1, wherein the first period is 1 horizontal period or more.

15. The display device of claim 1, wherein the second period is 1 horizontal period or more.

16. The display device of claim 1, wherein the first transistor is an n-channel transistor, and the first terminal and the second terminal of the light emitting element are an anode and a cathode, respectively.

17. The display device of claim 16, wherein the reference voltage is lower than the black voltage.

18. The display device of claim 1, wherein the first transistor is a p-channel transistor, and the first terminal and the second terminal of the light emitting element are the cathode and the anode, respectively.

19. The display of claim 18, wherein the reference voltage is higher than the black voltage.

20. The display device of claim 1, further comprising a detector connected to the voltage supply line to detect a voltage of the voltage supply line in a non-display period, during which the plurality of pixels do not display an image corresponding to the input image signal, wherein, in the non-display period, the at least one second transistor transmits a predetermined voltage in a state in which the third transistor is turned on, and the voltage supply line transmits a voltage of the first terminal of the light emitting element, instead of the reference voltage, to the detector.

21. A display device, comprising:

a signal line to transmit a first control signal, the first control signal comprising a first switch-on voltage in a first period and a second period;

a scan line to transmit a scan signal, the scan signal comprising a second switch-on voltage in a third period;

a data line to transmit a gray voltage that corresponds to an input image signal in the third period;

a light emitting element that comprises a first terminal and a second terminal, the second terminal being connected to a first driving voltage;

a first transistor that comprises a control terminal, a first terminal, and a second terminal, the second terminal being connected to the first terminal of the light emitting element;

a second transistor connected between the data line and the control terminal of the first transistor, the second transistor being turned on in response to the second switch-on voltage of the scan signal;

a third transistor connected between a black voltage that corresponds to a black gray and the control terminal of the first transistor, the third transistor being turned on in response to the first switch-on voltage of the first control signal;

a fourth transistor connected between the first terminal of the light emitting element and a reference voltage, the fourth transistor being turned on in response to a third switch-on voltage of a second control signal, the second control signal comprising the third switch-on voltage in the first period and a switch-off voltage in the second period, and a capacitor connected between the control terminal and the second terminal of the first transistor.

22. The display device of claim 21, further comprising a second signal line to transmit a third control signal, the third control signal comprising the first switch-on voltage earlier than the first control signal, wherein the second control signal is the third control signal.

23. The display device of claim 21, further comprising a fifth transistor connected between the first terminal of the first transistor and a second driving voltage, the second driving voltage being different from the first driving voltage, the fifth transistor being turned off in response to the second switch-on voltage of the scan signal.

24. A method of driving a display device that comprises a driving transistor comprising a control terminal, a first terminal, and a second terminal, at least one switching transistor connected to the control terminal of the driving transistor, a light emitting element comprising a first terminal and a second terminal connected to a first driving voltage, and a capacitor connected between the control terminal and the second terminal of the driving transistor, the method comprising:

applying a black voltage that corresponds to a black gray to the control terminal of the driving transistor through the at least one switching transistor in a first period and a second period;

connecting the first terminal of the light emitting element to a reference voltage in the first period;

separating the first terminal of the light emitting element from the reference voltage in the second period; and applying a gray voltage that corresponds to an input image signal to the control terminal of the driving transistor through the at least one switching transistor in a third period.

25. The method of claim 24, further comprising:

transmitting a second driving voltage different from the first driving voltage to the first terminal of the driving transistor in the third period.

26. The method of claim 24, further comprising:

separating the first terminal of the driving transistor from the second driving voltage, the second driving voltage being different from the first driving voltage, in the third period; and transmitting the second driving voltage to the first terminal of the driving transistor in a fourth period after the third period.

27. The method of claim 24, further comprising separating the first terminal of the light emitting element from the reference voltage in the fourth period before the first period.

28. The method of claim 24, further comprising:

separating the control terminal of the driving transistor from the black voltage in a fourth period between the second period and the third period; and separating the first terminal of the light emitting element from the reference voltage in the fourth period.

* * * * *